US005970295A

United States Patent [19]

Samizo

[11] Patent Number: 5,970,295

[45] Date of Patent: Oct. 19, 1999

[54] DOUBLE-SIDED IMAGE FORMING APPARATUS

[75] Inventor: Ken Samizo, Ebina, Japan

[73] Assignee: Fuji Xerox Co., Ltd., Tokyo, Japan

[21] Appl. No.: 09/177,109

[22] Filed: Oct. 22, 1998

[30] Foreign Application Priority Data

Nov. 13, 1997 [JP] Japan ..... 9-329582

[51] Int. Cl.[6] ..... G03G 15/00; G03G 21/00

[52] U.S. Cl. ..... 399/309; 399/306; 399/302

[58] Field of Search ..... 399/309, 302, 399/308, 364, 299, 306

[56] References Cited

U.S. PATENT DOCUMENTS

| | | | |
|---|---|---|---|
| 3,580,670 | 5/1971 | Bhagat . | |
| 3,936,171 | 2/1976 | Brooke . | |
| 4,162,844 | 7/1979 | Traister et al. . | |
| 4,427,285 | 1/1984 | Stange . | |
| 4,958,187 | 9/1990 | Tsuchiya et al. . | |
| 5,550,624 | 8/1996 | Wachtler . | |
| 5,740,510 | 4/1998 | Bogaert et al. | 399/298 |
| 5,797,077 | 8/1998 | Samizo et al. | 399/309 |
| 5,805,967 | 9/1998 | De Bock et al. | 399/299 |
| 5,848,323 | 12/1998 | Umeda et al. | 399/66 |

FOREIGN PATENT DOCUMENTS

| | | |
|---|---|---|
| 63-63057 | 3/1988 | Japan . |
| 1-209470 | 8/1989 | Japan . |
| 2-259670 | 10/1990 | Japan . |
| 8-108449 | 4/1996 | Japan . |

*Primary Examiner*—Richard Moses
*Attorney, Agent, or Firm*—Oliff & Berridge PLC

[57] ABSTRACT

In a double-sided image forming apparatus for forming images on both front and back surfaces of a recording medium by two image forming units, an image position adjusting means is provided for matching the positions of the images formed on both front and back surfaces of a recording medium by the two image forming units.

16 Claims, 21 Drawing Sheets

DOUBLE-SIDED IMAGE FORMING APPARATUS

BACKGROUND OF THE INVENTION

1. Field of the Invention

The present invention relates to an image forming apparatus such as an electrophotographic copier, a printer, etc. and more particularly to an improvement of a double-sided image forming apparatus capable of forming a double-sided image on the front and back surfaces of a recording medium.

2. Description of the Related Art

A related double-sided image forming apparatus capable of forming a double sided image generally adopts a system in which after a first image formed on a latent image carrier such as a photosensitive body is transferred and fixed on the first surface of a sheet of paper, the sheet is inverted and fed again and a second image formed on the latent image carrier is transferred and fixed on the second surface of the sheet.

This system, however, has the following defects. Since the sheet is passed twice through an image forming unit, productivity per a sheet of paper is ½ or less as slow as that in single-sided recording. Further, since the sheet curls at the first time of fixing, during the second time of transferring and fixing, poor transfer, paper wrinkle, and jam on a carrying passage are likely to occur. In addition, noise occurs when the sheet is inverted and fed again.

In order to solve such a problem, a double-sided image forming apparatus has been proposed in which a first toner image (first image) and a second toner image (second image) are respectively formed on two photosensitive bodies located oppositely, and thereafter the first image and second image on the respective photosensitive bodies are transferred simultaneously on both sides of a sheet of paper (e.g. JP-A-63-63057 and JP-A-2-259670).

Further, another double sided-image forming apparatus has also been proposed in which a single photosensitive body (e.g. photosensitive drum) carrying a first image and a second image and an intermediate transfer belt for holding the first image once are provided, a first transfer unit for transferring the respective images on the photosensitive body on the intermediate transfer belt or sheet of paper is arranged at a first transfer area; and a second transferring unit for transferring the first image on the intermediate transfer belt on the sheet and a sheet separator are arranged at the sheet discharge terminal of the intermediate transfer belt (e.g. JP-A-1-209470).

Further, the applicant of this application has already proposed a double-sided image forming apparatus in which with a first and second image forming units each composed of a photosensitive body and an intermediate transfer belt being provided so as to correspond to both surfaces of a sheet of paper, respectively, the images onto the photosensitive bodies are transferred primarily on the corresponding intermediate transfer belts, respectively, and the first and second images on the intermediate transfer belts are transferred secondarily on both surfaces of the sheet, respectively (JP-A-8-108449).

These systems, which is capable of double-sided recording by passing the sheet only once -through the image forming unit, can enhance the productivity while solving the above problem.

However, it has been found that the above double-sided image forming apparatus encounters the following technical problem. Even if the first and second image forming units are arranged symmetrically, minute speed variation due to a load change in the photosensitive body and intermediate transfer belt or the like, makes a difference in the tip positions of the first and second images for the sheet and magnification factor.

Such a technical problem is particularly remarkable in a system of using a belt-shaped photosensitive body or intermediate transfer belt since the above minute speed variation is affected by extension of the belt-shaped photosensitive body and intermediate transfer belt in addition to their load variation It has been found that a full-color image recording system further encounters a technical problem that color discrepancy occurs among color components (e.g. yellow (Y), magenta (M), cyan (C) and black (K)), so that the image quality is greatly impaired.

SUMMARY OF THE INVENTION

The present invention has been accomplished in order to solve the technical problem as described above, and intends to provide a double-sided image forming apparatus which is capable of giving the same productivity per a single sheet of recording medium for the double-sided recording as for the single-sided recording, and of minimizing position discrepancy between the images on the front and back surfaces of the recording medium (position discrepancy of the tips of the images, difference in the magnification factors and color discrepancy in the full color image recording).

To solve the above object, there is a double-sided image forming apparatus includes two image forming units for forming images on both front and back surfaces of a recording medium, and an image position adjusting unit for matching the positions of the images formed on both the front and back surfaces of the recording medium by the two image forming units.

BRIEF DESCRIPTION OF THE DRAWINGS

Similar reference characters denote corresponding features consistently throughout the attached figures. The preferred embodiments of this invention will be described in detail, with reference to the following figures, wherein.

DETAILED DESCRIPTION OF THE PREFERRED EMBODIMENTS

[Basic configuration]

Figure 1A:
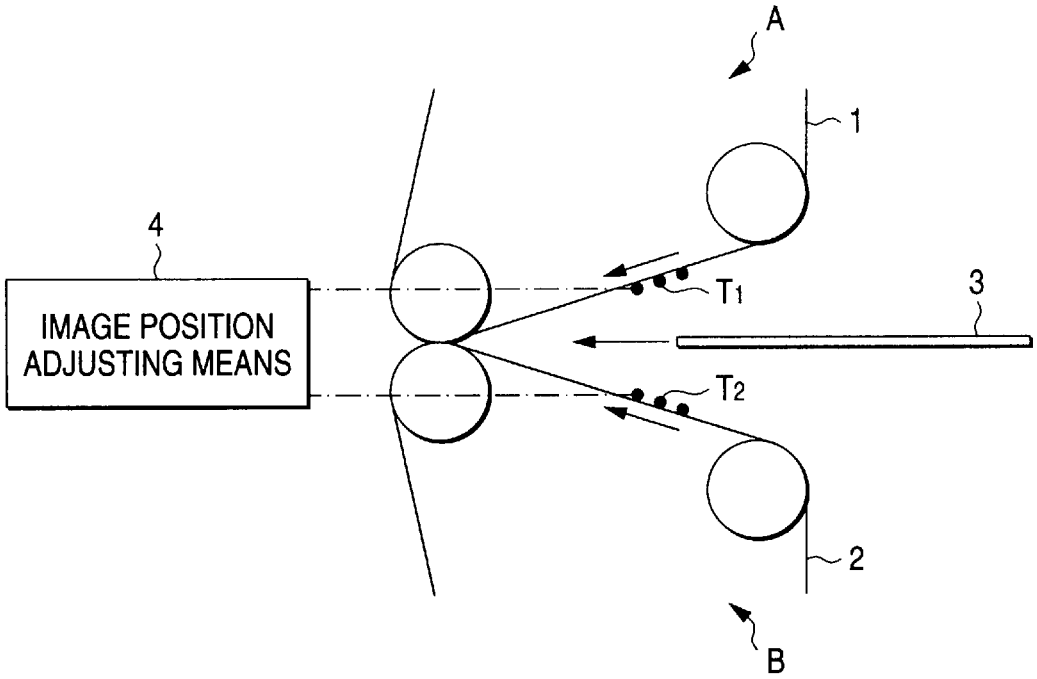
FIG. 1A is a view explaining the schematic of a double-sided image forming apparatus according to the present invention.

Specifically, the present invention, as shown in FIG. 1A, is a double-sided image forming apparatus for forming images on both front and back surfaces of a recording medium 3 by two image forming units (a first image forming unit A and a second image forming unit B) including an image position adjusting means 4 for matching the positions of the images (a first image T1 and a second image T2) formed on both front and back surfaces of a recording medium by using the two image forming units.

In such a technical means, two image, the two image forming units A and B may be configured in such a fashion that a pair of image carriers 1 and 2 for carrying/transporting the front and back images T1 and T2, respectively, are arranged oppositely to each other, or otherwise the one of the two image forming units A and B may have an image carrier 1 whereas the other may share the image carrier 1 and an image carrier 2 opposite thereto.

The image carriers 1 and 2 may be any means as long as they can carry the images T1 and T2, respectively. For example, only image forming carriers, such as a photosensitive drum on which the images T1 and T2 are formed and carried, are provided. Otherwise, there are provided the image forming carriers and intermediate transfer units which are arranged oppositely thereto and on which the images T1 and T2 are temporarily transferred by primary transferring means. Further, otherwise, the image forming carrier is provided for the one image forming unit whereas the combination of the image forming carrier and intermediate transfer unit is provided for the other image forming unit.

From the standpoint of efficiently suppressing a difference in an image quality between both images, it is desired that both image forming units for the first image T1 and T2 have only the image forming carrier, or a combination of the image forming carrier and intermediate transfer unit.

Form the standpoint of assuring the freedom of layout, it is desired that each image forming units is constructed in a combination of the image forming carrier and intermediate transfer unit having a belt-shape. But the one intermediate transfer unit may be drum-shaped while the other intermediate transfer unit may be belt-shaped. As long as they have certain elasticity in a radial direction, both intermediate transfer units may be drum-shaped.

In a manner of simultaneously transferring images on both surfaces of a recording medium 3, in which the first image T1 and the second image T2 are formed by electrophotography for example, the first and second images T1 and T2 carried on the image carriers 1 and 2 should have polarities opposite to each other on a transferring area.

In this case, the materials of inherently opposite polarities may be used for the first image T1 and second image T2. Otherwise, using the material having the same polarity, a polarity inverting means may be provided at a suitable position to invert the polarity of the one image.

Figure 1B:
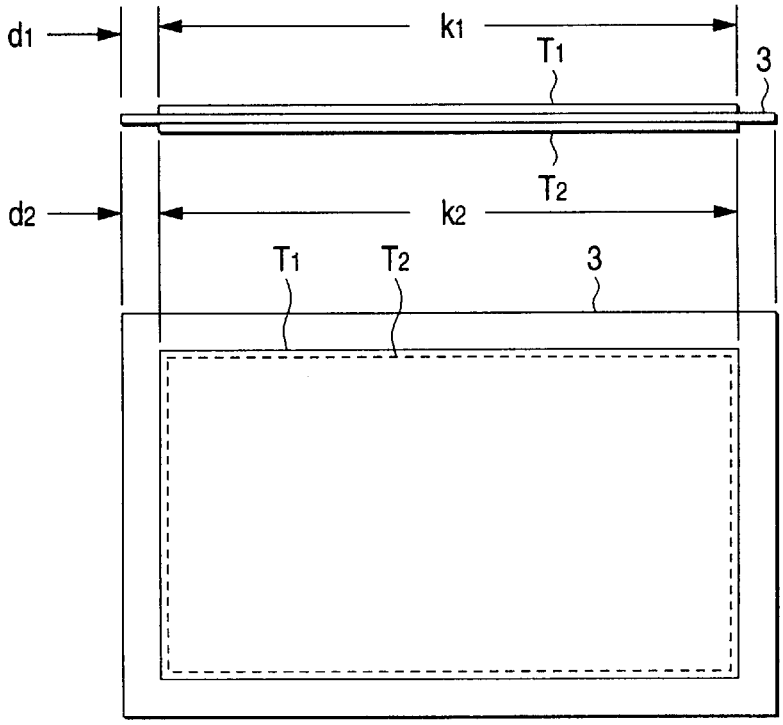
FIG. 1B is a view explaining the operation thereof.

The image position adjusting means 4, as shown in FIG. 1B, may match at least the positions (d1 and d2) from the tip of the recording sheet 3 of the images T1 and T2 formed on the front and back surfaces of the recording medium 3 by the image forming units A and B, or otherwise match at least the magnification factors of the images T1 and T2 so that the size lengths (k1 and k2) coincide with each other. From the standpoint of causing the positions of the images to coincide each other accurately, it is preferable that the positions (d1 and d2) from the tip of the recording sheet 3 and the magnification factors of the images T1 and T2 formed on the front and back surfaces of the recording medium 3 by the image forming units A and B are caused to coincide with each other.

In a system of matching or aligning the images T1 and T2 by the image position adjusting means 4, the timings of forming the image by the image forming units A and B may be matched with the same reference value, or otherwise, the image forming timing in the one image forming unit A may be matched with that in the other image forming unit B.

When the images T1 and T2 are matched or aligned by the image position adjusting means 4, a position difference (error) between both images T1 and T2 can be detected.

The system of detecting the position difference can be realized in such a fashion that reference patches are formed on the image carriers 1 and 2 provided for the image forming units A and B to recognize a position difference between the positions of the images T1 and T2 on the basis of detection results of the reference patches by detecting means, or otherwise reference marks are formed on the image carriers 1 and 2 provided for the image forming units A and B to recognize a position defference between the positions of the images T1 and T2 on the basis of detection results of the reference marks by detecting means.

Figure 2:
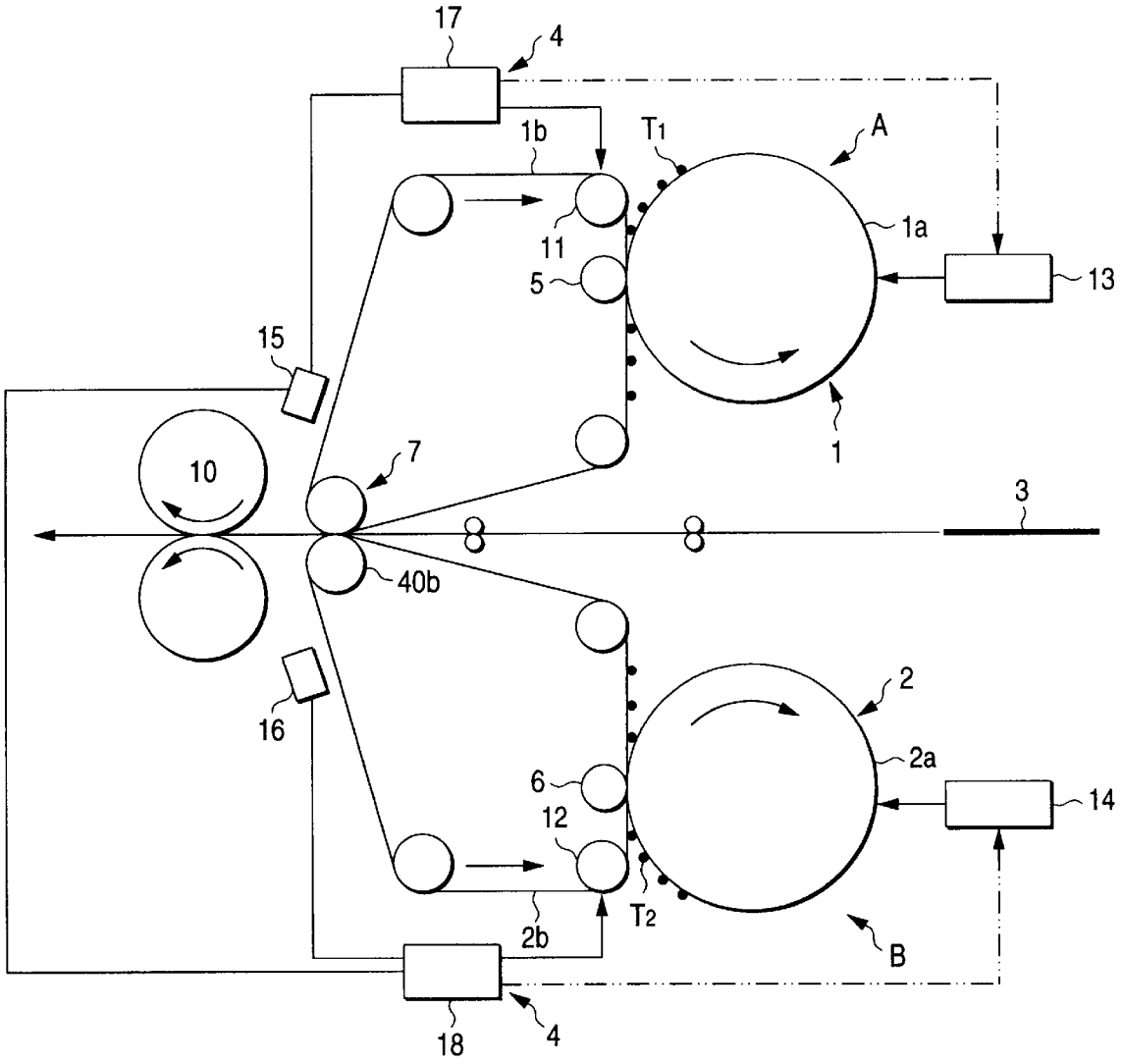
FIG. 2 is a view explaining a specific fashion of the present invention.

A detailed explanation will be given of the present invention with reference to a double-sided image forming apparatus as shown in FIG. 2. In FIG. 2, the double-sided image forming apparatus a first image carrier la carrying a first image, a first intermediate transfer unit 1*b* opposite to the first image carrier 1*a*, a first intermediate primary transferring means 5 for making primary transfer of the first image T1 on the first image carrier 1*a* to the first intermediate transfer unit 1*b*, a second image carrier 2*a* carrying the second image T2, a second intermediate transfer unit 2*b* opposite to the second image carrier 2*a*, a second intermediate primary transferring means 6 for making the primary transfer of the second image T2 on the second image carrier 2*a* to the second intermediate transfer unit 2*b*, and an intermediate secondary transferring means 7 for making the secondary transfer of the primary transferred images T1 and T2 on the respective intermediate transfer units 1*b* and 2*b* on both sides of a recording medium 3.

The first image carrying element 1 is composed of the first image carrier 1*a* and first intermediate transfer unit 1*b*, while the second image carrying element 2 is composed of the second image carrier 2*a* and second intermediate transfer unit 2*b*. The first image forming unit A is composed of the first image carrying element 1, first intermediate primary transferring means 5 and intermediate secondary transferring means 7, while the second image forming unit B is composed of the second image carrying element 2, second intermediate primary transferring means 6 and intermediate secondary transferring means 7 (common to the first image forming unit A). Incidentally, in FIG. 2, reference numeral 10 denotes a fixing means for fixing the front and back images T1 and T2 on the recording medium 3.

In such a double-sided image forming apparatus, an image position adjusting means 4 is realized in the several following fashions.

In the first fashion which is typical, reference patches are formed on the first and second image carriers 1*a* and 2*a*, respectively and the reference patches are transferred on the first and second intermediate transfer units 1*b* and 2*b*. Thereafter, on the basis of detection of the reference patches by a detecting means, the positions of the front and back images, which are formed on the front and back surfaces of the recording medium 3, are matched or aligned with each other.

In the second fashion, reference marks are formed on the first and second intermediate transfer units 1*b* and 2*b*, respectively, and on the basis of detection of the reference marks by the detecting means, the positions of the front and back images, which are formed on the front and back surfaces of the recording medium 3, are matched with each other.

In these fashions, the double-sided image forming apparatus may include a first detecting means 15 for detecting the reference patch or reference mark formed on the first intermediate transfer unit 1*b*, a second detecting means 16 for detecting the reference patch or reference mark formed on the second intermediate transfer unit 2*b*, and first and second control means 17 and 18 for matching the positions of the front and back images formed on the front and back surfaces of the recording medium 3 on the basis of the detection results by the first and second detecting means 15 and 16.

In these fashions, as indicated by solid lines in FIG. 2, for example, the respective driving elements 11 and 12 of the first intermediate transfer unit 1*b* and second intermediate transfer unit 2*b* (e.g. driving rolls of the intermediate transfer units in the form of belts) may be controlled so that the driving periods of the intermediate transfer units 1*b* and 2*b* are matched with each other. Otherwise, as indicated by broken lines in FIG. 2, image writing means 13 and 14 used to write images on the image carriers 1*a* and 2*a* (e.g. exposure means used to write electrostatic latent images in the image forming apparatus in a system of electrophotography) may be controlled so that the image writing timings on the image carriers 1*a* and 2*a* are adjusted. Both controlling manners may be combined with each other.

The first and second control means 17 and 18 may compare the detection results from the first and second detecting means 15 and 16 with reference signals to control in accordance with the differences therebetween individually the respective driving elements 11 and 12, and respective image writing means 13 and 14. Otherwise, they may compare the detection results from the first and second detecting means 15 and 16 with each other to control the driving elements 11 or 12 and image writing means 13 or 14 so that the one is caused to coincide with the other.

In the above first and second fashions, the first and second detecting means 15 and 16 may be constructed by a single means.

Such a fashion can be realized in FIG. 2 as follows. The first reference patch is formed on the first intermediate transfer unit 1*b*, while the second reference patch is formed on the second intermediate transfer unit 2*b*. Thereafter, for example, the second reference patch is transferred on the first intermediate transfer unit 1*b*. The first and second reference patches are detected by the first detecting means 15. On the basis of this detection result, the first and the second driving elements 11 and 12 and the first and the second image writing means 13 and 14 are controlled by the first and the second control means 17 and 18.

This fashion is preferable in that by detecting the first and the second reference patch by the same detecting means, cost can be reduced and a difference in the detection result due to attachment of the detecting means can also be removed.

In the first and the second fashion, the first and the second control means 17 and 18 maybe constructed by a single means.

Such a fashion can be realized in FIG. 2 as follows. The detection results of the first and the second detecting means 15 and 16 are compared with each other. Thereafter, in order that the one result is caused to coincide with the other result, the driving element 11 or the image writing means 13 is controlled by the first control means 17, or otherwise the driving element 12 or image writing means 14 is controlled by the second control means 18.

In the configuration in FIG. 2, since the first intermediate unit 1*b* and the second intermediate unit 2*b* carry color images (front and back images) T1 and T2 consisting of multiply superposed plural colors of image components, to form the color images T1 and T2 with no disorder, there is provided contact/separation means capable of separating both intermediate transferring units 1*b* and 2*b* when the images on the intermediate transferring units 1*b* and 2*b* pass the secondary transfer area without being transferred on the recording medium 3 and bringing both intermediate transferring units 1*b* and 2*b* into contact with or proximity to each other when the images on the intermediate units 1*b* and 2*b* are transferred on the recording medium 3.

The color images can be preferably formed in a short time in such a fashion that the first image carrier 1*a* and second image carrier 2*a* includes plural groups of color component image carriers, which carry plural colors of image components, respectively, while the first intermediate transfer unit 1*b* and second intermediate transfer unit 2*b* transfer and hold the image components transferred from the plural groups of color component image carriers carried by the first image carrier 1*a* and second image carrier 2*a*.

An explanation of the operation of the above technical means will be described below.

In FIG. 1A, the image position adjusting means 4 matches the positions of the front and back images T1 and T2 with each other, which are formed on the front and back surfaces on the recording medium 3 by the corresponding image forming units A and B.

Therefore, as shown in FIG. 1B, the positions of the front and back images T1 and T2 from the tip of the recording medium 3 and the magnification thereof are matched with each other and the magnifications thereof are made equal to each other so that a variation in the positions on the front and back images T1 and T2 can be suppressed.

Such an operation will be explained below with reference to, for example, the first fashion of the technical means shown in FIG. 2.

The first and the second reference patches are respectively formed on the first-image carrier 1*a* and second image carrier 2*a*. The first reference patch is primarily transferred on the first intermediate transfer unit 1*b* by the first intermediate primary transferring means 5, and the second reference patch is primarily transferred on the second intermediate transfer unit 2*b* by the second intermediate primary transferring means 6.

Thereafter, when the first and the second reference patches are detected by the first and the second detecting means 15 and 16, respectively, on the basis of the detection results, the first and the second control means 17 and 18 respectively control the rotation each of the driving elements 11 and 12 of the first and the second intermediate transfer units 1*b* and 2*b*, so that the rotary periods of the intermediate transfer units 1*b* and 2*b* are matched with each other, or control the first and the second image writing means 13 and 14 to adjust the writing timings of the images.

Accordingly, the positions of the front and back images T1 and T2 of the recording medium 3 (image tip position and image magnification) can be matched with each other.

Hereinafter, a detailed explanation of the present invention will be given with reference to embodiments as shown in the drawings.

[First Embodiment]

Figure 3:
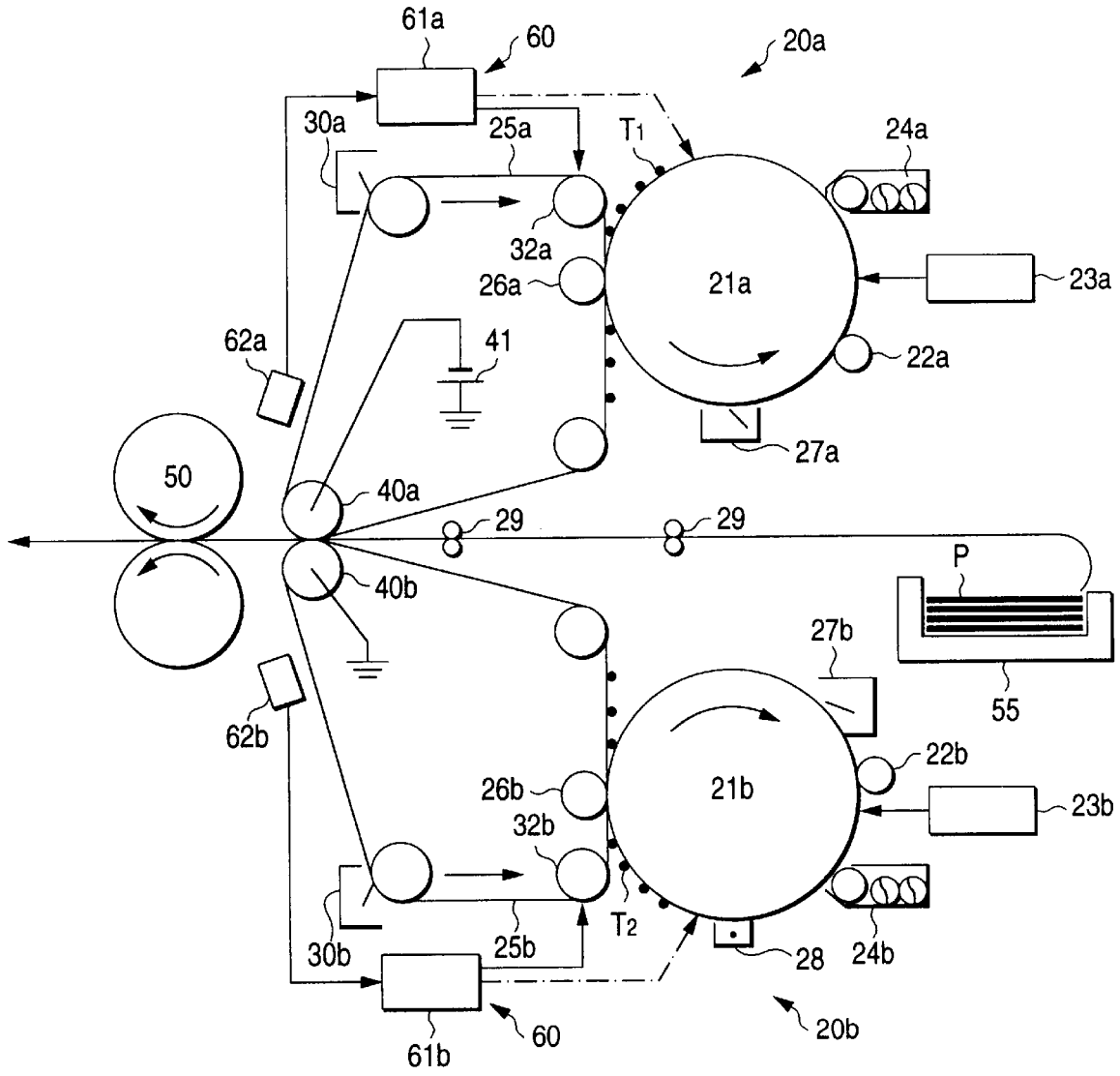
FIG. 3 is a schematic arrangement view showing a double-sided image forming apparatus according to a first embodiment.

FIG. 3 shows a schematic configuration of the first embodiment of a double-sided image forming apparatus to which the present invention is applied.

In FIG. 3, the double-sided image forming apparatus includes a first image forming unit 20*a* for forming a first image on the first surface of a sheet of paper, a second image forming unit 20*b* for forming the second image on the second surface of the sheet of paper, and a fixer 50 for fixing the images on the sheet P which have passed the image forming units 20*a* and 20*b*.

In this embodiment, each image forming unit 20*a*, 20*b* includes a photosensitive drum 21*a*, 21*b*; a charging roll 22*a*, 22*b* for charging the surface of the photosensitive drum 21*a*, 21*b*; an exposure device 23*a*, 23*b* for writing an electrostatic latent image for a first and a second image on the charged photosensitive drum 21*a*, 21*b*; a developing device 24*a*, 24*b* for revealing the electrostatic latent image written in the photosensitive drum 21*a*, 21*b* using toners; an intermediate transfer belt 25*a*, 25*b* arranged in contact with the photosensitive drum 21*a*, 21*b*; a primary transfer roll 26*a*, 26*b* for primarily transferring the toner image T1, T2 (positive image in this embodiment) on the photosensitive drum 21*a*, 21*b* onto an intermediate transfer belt 25*a*, 25*b*; and a cleaner 27*a*, 27*b* for cleaning or removing the toners remaining on the photosensitive drum 21*a*, 21*b*.

A polarity inverting corotron 28 is arranged downstream of the developing position of the photosensitive drum 21*b* of the second image forming 20*b*.

Of the first, second image forming unit 20*a*, 20*b*, at least the photosensitive drum 21*a*, 21*b*; exposure device 23*a*, 23*b*; intermediate transfer belt 25*a*, 25*b* and primary transfer roll 26*a*, 26*b* are in a symmetrical configuration with respect to a paper carrier passage.

In this embodiment, each intermediate transfer belt 25*a*, 25*b* is hung over a suitable number of holding rolls inclusive of a driving roll 32*a*, 32*b* and rotates in synchronism with the photosensitive drum 21*a*, 21*b*. Reference numeral 30*a*, 30*b* designates a belt cleaner for cleaning the toners remaining on the intermediate transfer belt 25*a*, 25*b*.

The intermediate transfer belt 25*a*, 25*b* is made of resin such as polyimide, acryl, vinyl chloride, polyester and polycarbonate, polyethylene terephthalate (PET) or several kinds of rubbers containing a suitable quantity of an anti-static agent, having a volume resistivity of $10^{6}$–$10^{14}$ Ω.cm and a thickness of e.g. 0.08 mm.

A holding roll is arranged as a secondary transfer roll 40*a*, 40*b* at an area in contact or proximity with each intermediate transfer belt 25*a*, 25*b*.

Both secondary transfer rolls 40*a* and 40*b* which are electrically conductive permit to transfer. However, at least a bias applying roll is preferably semiconductive or covered with an insulating material. The reason is as follows. Where the transfer is made on a small size of sheet of paper, when each of the first and second intermediate transfer belts 25*a*, 26 is brought into direct contact with each other, an excessive current flows between the secondary transfer rolls 40*a* and 40*b*. This may make it impossible to generate a sufficient electric field for transfer, thus leading to poor transfer or damage of the intermediate transfer belt 25*a*, 25*b*.

In this embodiment, each secondary transfer roll 40*a*, 40*b* has a metallic shaft covered with an EPDM rubber containing dispersed carbon blacks to have a volume resistivity of $10^{6}$ Ω.cm. A transfer bias from a bias voltage source 41 is applied to the shaft of the secondary transfer roll 40*a* and the shaft of the secondary transfer roll 40*b* is grounded. The secondary transfer roll 40*a*, 40*b* may have a rubber hardness of 70 degree (Asker C). If desired, the secondary transfer roll 40*a*, 40*b* may be used as a tension roll. In addition, in order to prevent the slippage of the intermediate transfer belt 25*a*, 25*b*, the rubber hardness (Asker C) of the secondary transfer roll 40*a* may be 50 degree or higher, or preferably 70 degree or higher.

The covering material may be also polyurethane rubber or silicon rubber containing conductive particles (carbon black or aluminum) or ion conducting agent ($LiClO_4$), preferably having a volume resistivity of $10^{5}$–$10^{9}$ Ω.cm.

In this embodiment, the toner images T1, T1 are formed of negative-charged toners. The primary transfer rolls 26*a* and 26*b* are supplied with DC currents of +10 μA, and −10 μA, respectively. The polarity inverting corotron 28 is supplied with a DC current of +400 μA from its wire and with a DC current of +500 from the grid.

The distance from the secondary transfer position to the fixer 50 is set to be shorter than the minimum length of sheet. The rotary speed of the fixing roll is set to be equal to or slightly slower than the speed of the intermediate transfer belt 25*a*, 25*b*.

The upper and lower fixing rolls of the fixer 50 are caused to have the same shape so that the fixing nip is linear. Heaters are arranged within the insides thereof, respectively. In FIG. 3, reference numeral 55 designates a paper tray and 29 designates a transporting roll for transporting a sheet of paper P.

In this embodiment, an image position adjusting device 60 is arranged for adjusting the positions of the front and back images on the sheet.

The image position adjusting device 60 includes a control part 61*a*, 61*b* and a position sensor 62*a*, 62*b*. The control part 61*a*, 61*b* serves to control the driving roll 32*a*, 32*b* of the intermediate transfer belt 25*a*, 25*b* on the basis of the position information of a reference patch, which is formed on the intermediate transfer belt 25*a*, 25*b* by the image forming unit 20*a*, 20*b*. The position sensor 62*a*, 62*b* serves to detect the reference patch formed on the intermediate transfer belt 25*a*, 25*b*.

The position sensors 62*a* and 62*b* are opposite to the image carrying surfaces of the intermediate transfer belts 25*a* and 25*b* and arranged separately on this side and inner side in the widthwise direction of the intermediate transfer belts 25*a* and 26*b*.

Figure 4:
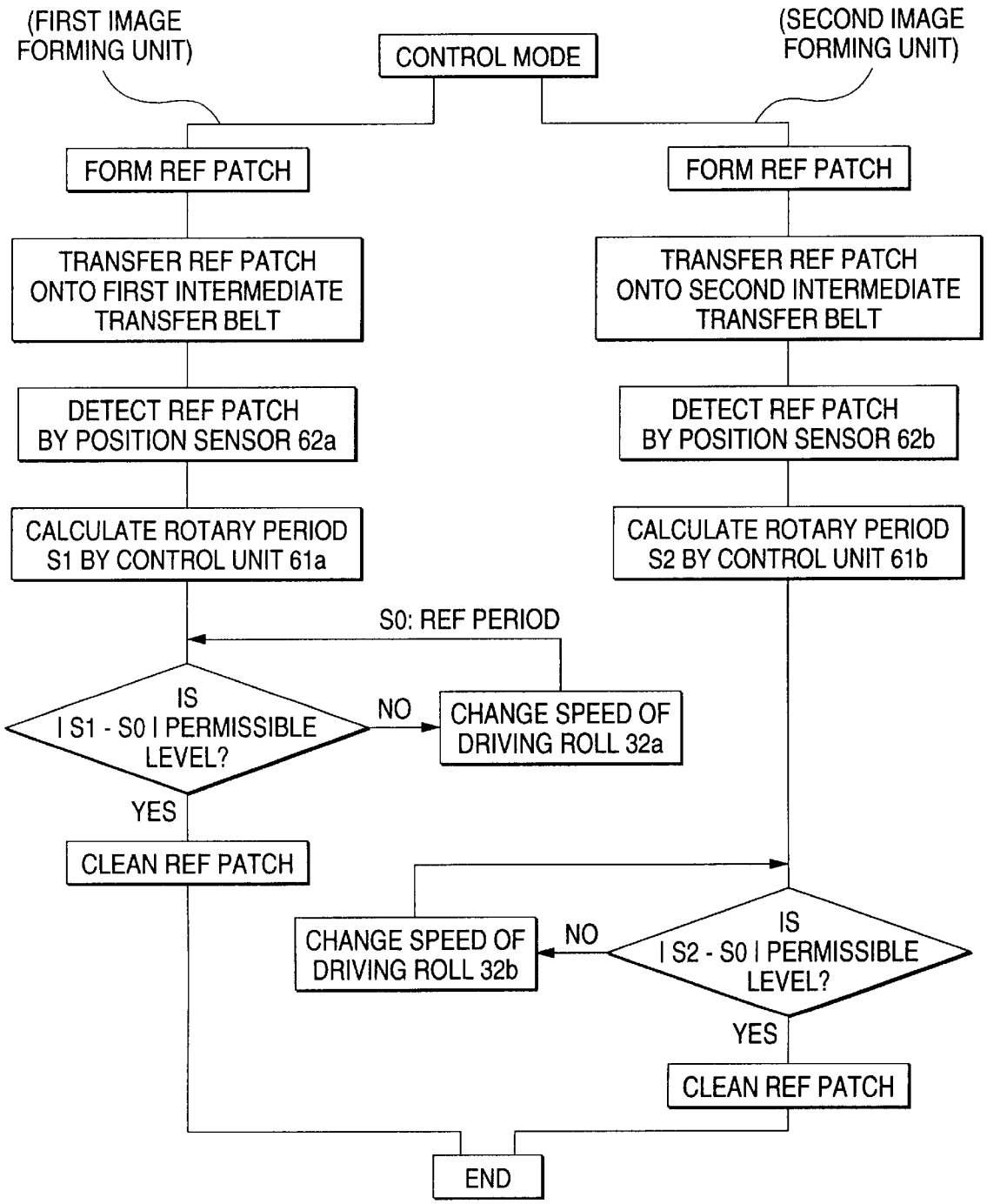
FIG. 4 is a flowchart showing specific control contents of a double-sided image forming apparatus according to the first embodiment.

The control part 61*a*, 61*b* is constructed by a microcomputer composed of a CPU, ROM, RAM and input/output interface, and designed to execute the control mode shown in FIG. 4 at predetermined timings.

It is not necessarily required that the control mode is executed whenever the image is formed. The control mode may be executed for each period (at the time of turn-on of power or for each of prescribed number of sheets). Otherwise, the control mode, which is made selectable, may be executed when it is selected.

An explanation will be given of a process of forming an image in the double-sided image forming apparatus according to this embodiment.

The first toner image T1 formed on the first photosensitive drum 21*a* is transferred on the first intermediate transfer belt 25*a*, which is moving at a speed equal to the first photosensitive drum 21*a*, by the primary transfer roll 26*a*.

Likewise, the second toner image T2 is formed on the second photosensitive drum 21*b* at the same timing as on the first photosensitive drum 21*b*. The polarity of the second toner image T2 is inverted by applying a voltage to the polarity inverting corotron 28. Thereafter, the second toner image T2 is transferred on the second intermediate transfer belt 25*b* by the first transfer roll 26*b*.

At the timing coincident with the above transfer, the sheet of paper P is transported to between the secondary transfer rolls 40*a*, 40*b* from the paper tray 55. The toner images T1 and T2 on the intermediate transfer belt 25*a* and 25*b* are transferred on both sides of the sheet P and fixed simultaneously by the fixer 50.

In the case of the single-sided recording, for example, by applying the bias opposite to a normal transfer bias to the primary transfer roll 26*a* or 26*b* not used for recording, stains on the back surface can be prevented. The stains can be also prevented by techniques of switching the development bias or of separating the photosensitive drum 21*a*, 21*b* from the intermediate transfer belt 25*a*, 25*b*.

In this way, the double-sided image recording can be realized at the same recording speed as the single-sided recording in such a manner that the toner images T1 and T2 are transferred from the photosensitive drums 21*a* and 21*b* onto the intermediate transfer belts 25*a* and 25*b*, respectively; the sheet P is transported to between the secondary transfer rolls 40*a* and 40*b*; and the images on the intermediate transfer belts 25*a* and 25*b* are transferred simultaneously on the sheet P and transported to the fixer 50 so that the images on both sides are simultaneously fixed.

In such a double-sided image forming apparatus, the image position adjusting device 60 executes the control mode as shown in FIG. 4 to match the positions of the front and back images each other on the sheet.

Specifically, a reference patch is formed on the photosensitive drum 21*a*, 21*b*, and is transferred on the intermediate transfer belt 25*a*, 25*b*, respectively. The reference patch is detected by the position sensor 62*a*, 62*b* to measure the rotary period S1, S2 of the intermediate transfer belt 25*a*, 25*b*. The rotary period S1, S2 is compared with a reference period S0 (reference value). On the basis of a difference therebetween, the rotary speed of the driving roll 32*a*, 32*b* is adjusted.

It should be noted that the reference period is determined from an ideal speed and peripheral length of the intermediate transfer belt 25*a*, 25*b*. For example, when the belt speed= 160 mm/s and the peripheral length=600 nm, the reference value is 600/160=3.75 s.

When the rotary speed of the driving roll 32*a*, 32*b* is controlled to a value corresponding to the reference period S0, each reference patch is cleaned by a belt cleaner 30*a*, 30*b*.

As described above, in this embodiment, the first and second image forming units 20*a* and 20*b* are arranged in a symmetrical configuration, the writing timings for the photosensitive drums 21*a* and 21*b* are simultaneously set, and further the above control is performed. This realizes coincidence of the tip positions of the images on the front and back sides of the sheet P and image magnifications on both sides.

If the distances from the exposure sections to the secondary transfer sections are equal to each other, the first and second image forming units 20*a* and 20*b* are not necessarily arranged symmetrically.

In the control mode, in order to prevent disorder of the images in the secondary transfer section, a bias reverse to the normal transfer in passage of the secondary transfer section may be applied, or the secondary transfer rolls 40*a* and 40*b* may be separated from each other.

In this embodiment, although the reference patches are formed, reference marks, which are formed on the intermediate transfer belt 25*a* and 25*b* may be detected.

It is needless to say that the position sensor 62*a*, 62*b* may be arranged upstream of the secondary transfer section.

In this embodiment, the toners having the same charging polarity were used and the polarity of the toner image T2 was inverted on the photosensitive drum 21*b*. But, the polarity may be inverted on the second intermediate transfer belt 25*b*. The toners having different charging polarities may be used.

In this embodiment, the one secondary transfer roll 40*a* was supplied with a transfer bias, whereas the other secondary transfer roll 40*b* was connected to ground. But, transfer biases having different polarities may be applied to both secondary transfer rolls 40*a* and 40*b*.

Such changes in design can be adopted as necessity requires in the embodiments described hereinbelow.

[Second Embodiment]

Figure 5:
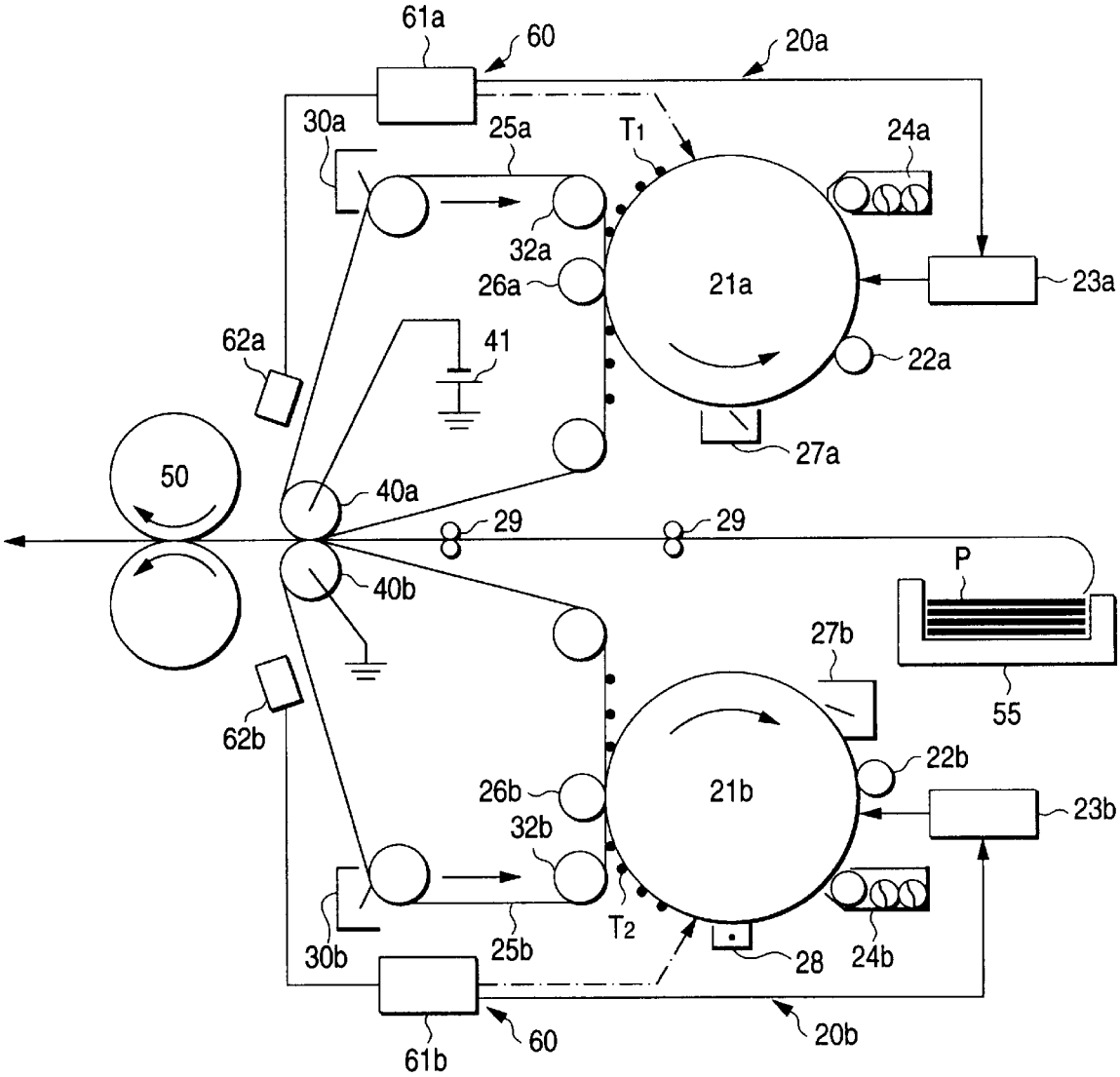
FIG. 5 is a schematic arrangement view showing a double-sided image forming apparatus according to a second embodiment.

FIG. 5 shows a schematic configuration of the second embodiment of the double-sided image forming apparatus to which the present invention is applied.

Figure 6:
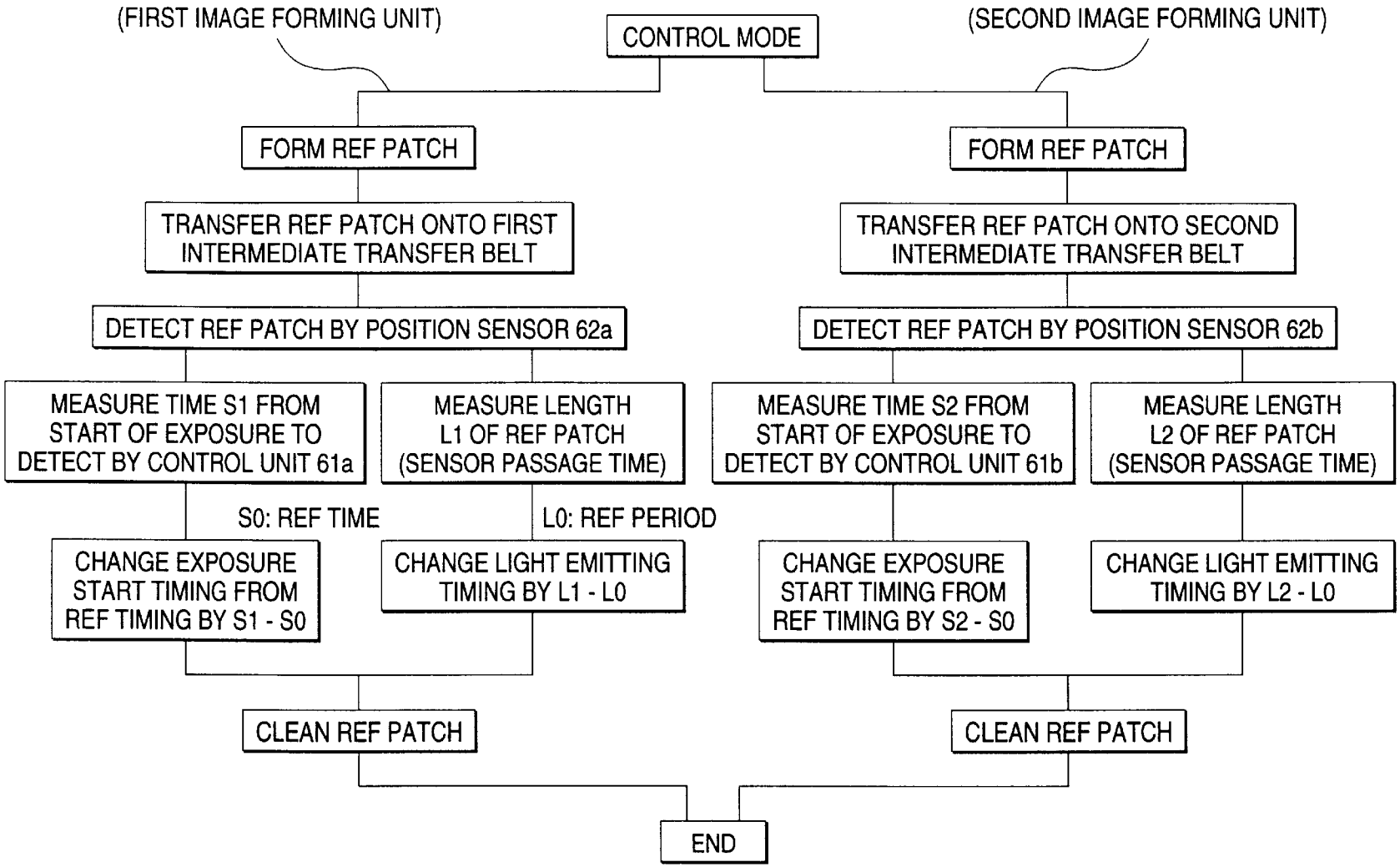
FIG. 6 is a flowchart showing specific control contents of a double-sided image forming apparatus according to the second embodiment.

In FIG. 5, the basic configuration of the double-sided is substantially the same as in the first embodiment. However, unlike the first embodiment, in this embodiment, the image position adjusting apparatus 60 executes the control mode as shown in FIG. 6. Specifically, on the basis of the detection result of the reference patch by the position sensor 62*a*, 62*b*, the control part 61*a*, 61*b* controls the writing timing of the exposure device 23*a*, 23*b*.

In this embodiment, the exposure device 23*a*, 23*b* may be a device (ROS: Raster Output Scanner) using a semiconductor laser as a scanning optical system.

In this embodiment and following embodiments also, like reference numerals refer to like elements in the first embodiment and will not be explained in detail.

In this embodiment, the image position adjusting device executes the following control mode to match the front and back images with each other on a sheet.

Specifically, a reference patch is formed on the photosensitive drum 21*a*, 21*b*, and is transferred on the intermediate transfer belt 25*a*, 25*b*. The reference patch is detected by the position sensor 62*a*, 62*b* to measure the time S1, S2 elapsed from the start of exposure (writing) to detection of the reference patch. The time S1, S2 is compared with a reference time S0 (reference value). On the basis of a difference therebetween, the writing starting timing of the exposure device 23*a*, 23*b* is adjusted.

The length L1, L2 in a process direction of the reference patch (corresponding to a passage time of the position sensor 62*a*, 62*b*) is measured. This length is compared with a reference time (L0). On the basis of a difference therebetween, the writing timing of the exposure device 23*a*, 23*b* is adjusted.

When the writing timing of the exposure device 23*a*, 23*b* is controlled as necessity requires, each reference patch is cleaned by a belt cleaner 30*a*, 30*b*.

As described above, in this embodiment, by performing the control described above, coincidence could be realized between the tip positions of the images on the front and back sides of the sheet P and image magnifications on both sides.

In this embodiment, although the length in a process direction of the reference patch was measured, a plurality of patches may be provided, and on the basis of the measurement result of the distance therebetween, control may be executed.

Figure 7:
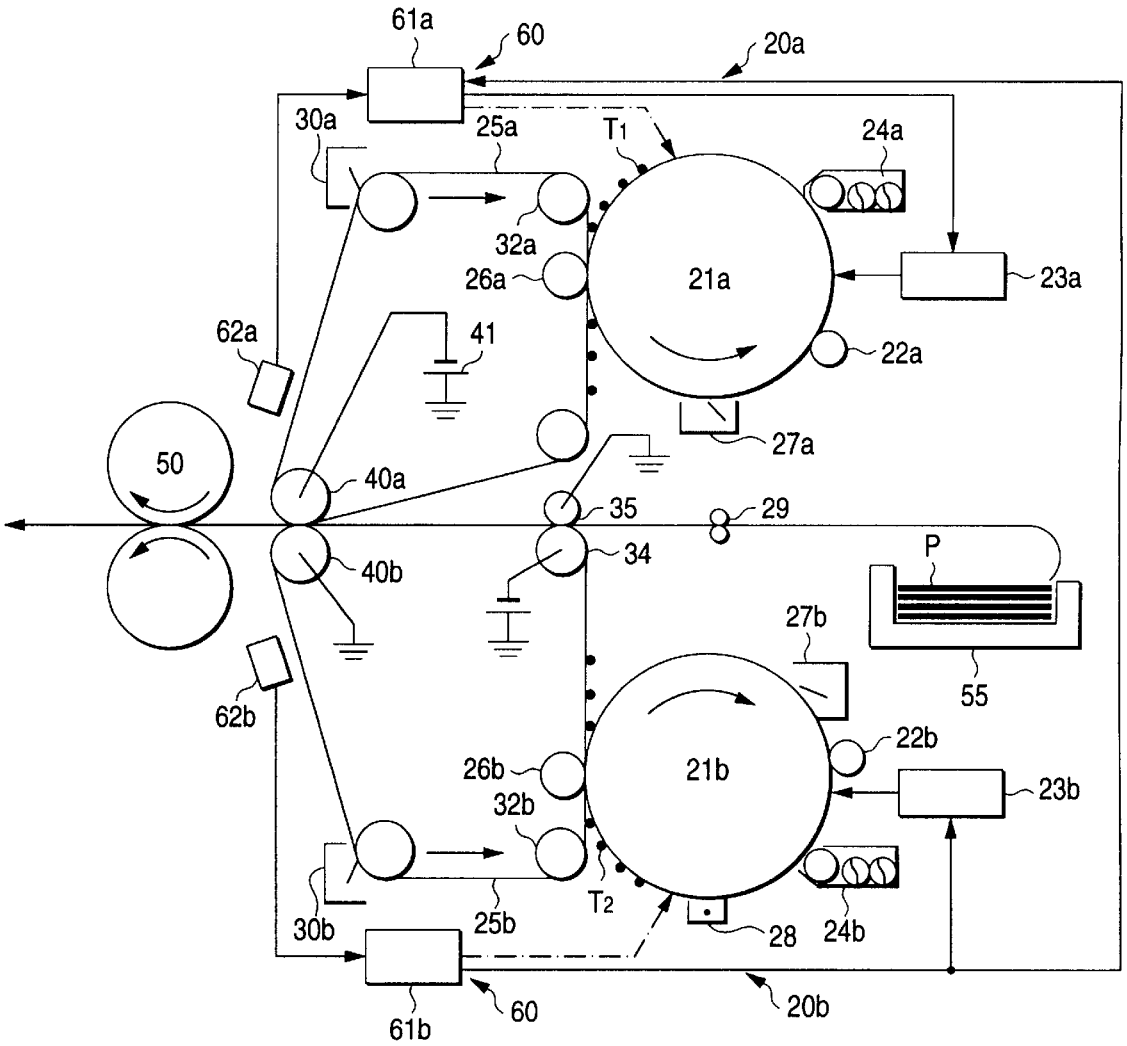
FIG. 7 is a schematic arrangement view showing a double-sided image forming apparatus according to a modification of the second embodiment.

FIG. 7 shows a modification of the second embodiment of the present invention.

As seen from FIG. 7, the double-sided image forming apparatus according to this modification has the same basic configuration as the second embodiment. But, unlike FIG. 5, the first and the second intermediate transfer belts 25*a* and 25*b* have asymmetrical shapes to each other, and the sheet P is adsorbed onto the second intermediate transfer belt 25*b* between a tension roll 34 with a bias applied and an adsorption roll 35 connected to ground, and transported to the second transfer section.

The position sensors 62*a* and 62*b* are arranged at the positions equal from the second transfer section downstream thereof, respectively.

In the apparatus according to this modification, since the distance from the first transfer section to the second transfer section is different for the first and second image forming units 20*a* and 20*b*, the writing starting timings of the first and the second exposure devices 23*a* and 23*b* cannot be made simultaneous.

Therefore, on the basis of the start of the writing of the second exposure device 23*b*, after a predetermined time from this start, the first exposure device 23*a* starts the writing. Thereafter, as in the case of FIG. 5, the time from start of the exposure (writing) to detection of the reference patch is measured. This time is compared with the reference time (reference value). On the basis of a difference therebetween, the writing starting timing of the exposure device 23*a*, 23*b* is adjusted.

The length in a process direction of the reference patch is measured. This length is compared with a reference time. On the basis of a difference therebetween, the writing timing of the exposure device 23*a*, 23*b* is adjusted.

As described above, in this modification, by performing the control described above, coincidence could be realized between the tip positions of the images on the front and back sides of the sheet P and image magnifications on both sides.

Even when the shapes of the first and the second intermediate belts 25*a* and 25*b* are asymmetrical, if the distance from the exposure position to the secondary transfer position is equal for the first and the second image forming units 20*a* and 20*b*, the same control as FIG. 5 can be performed.

[Third Embodiment]

Figure 8:
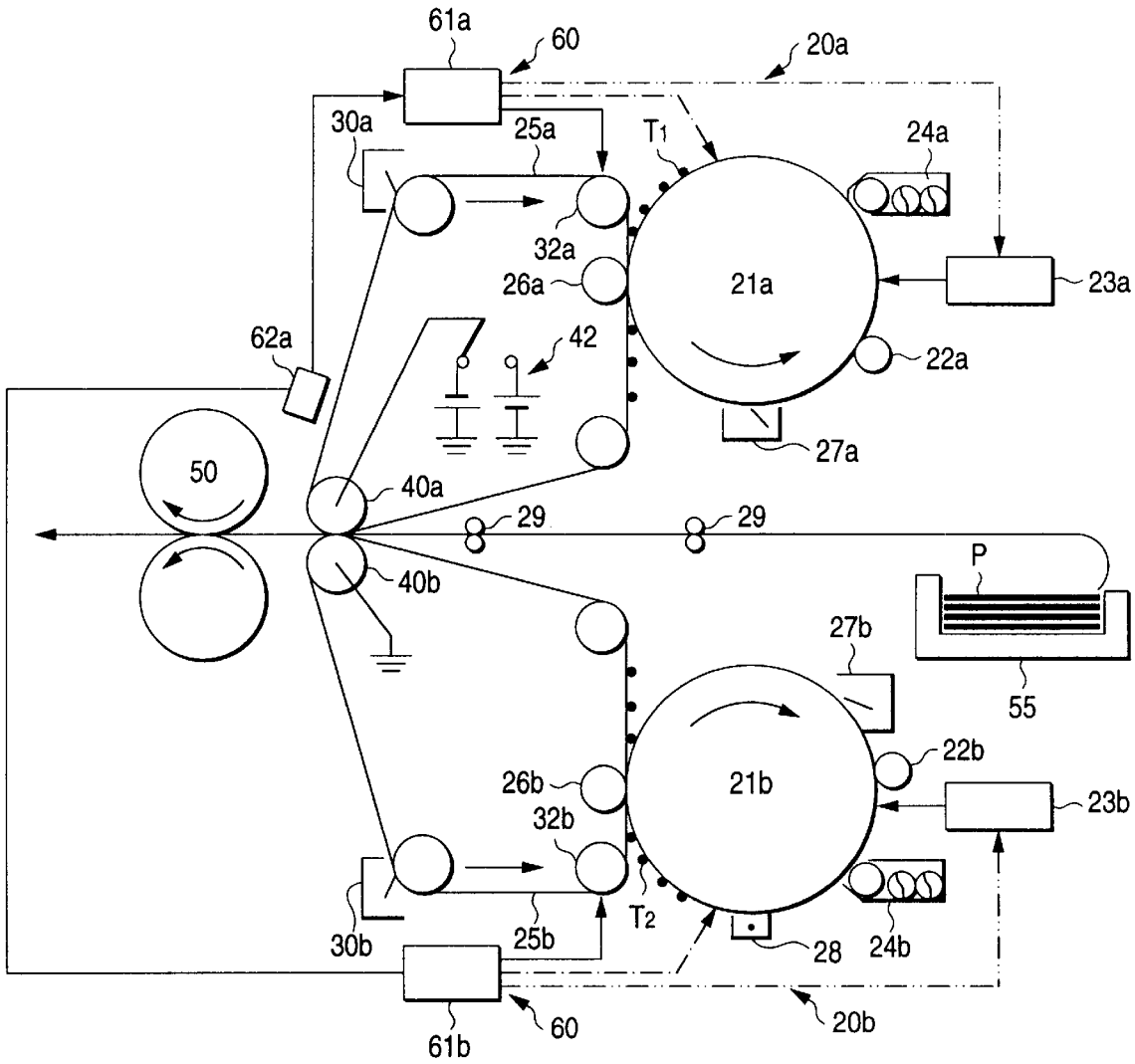
FIG. 8 is a schematic arrangement view showing a double-sided image forming apparatus according to a third embodiment.

FIG. 8 shows a schematic configuration of the third embodiment of the double-sided image forming apparatus to which the present invention is applied.

In FIG. 8, the basic configuration of the double-sided image forming apparatus is substantially the same as in the first embodiment. However, unlike the first embodiment, in this embodiment, the reference patch on the second intermediate transfer belt 25*b* is transferred onto the first intermediate transfer belt 25*a* and both reference patches are detected by a single position sensor 62. On the basis of the detection result, the image position adjusting apparatus 60 adjusts the positions of the front and back images of the sheet P.

In this embodiment, the secondary transfer roll 40*a* is provided with a bias voltage source 42 which can be switched between a transfer bias for normal recording and the bias reverse thereto.

In this embodiment, in the control mode, in order to transfer the reference patch on the second intermediate transfer belt 25*b* onto the first intermediate transfer belt 25*a*, first, without inverting the polarity of the toner image on the second photosensitive drum 21*b*, the reference patch is transferred onto the second intermediate transfer belt 25*b*. Subsequently, by applying the bias having a polarity reverse to that in the normal recording applied to the secondary transfer section, the reference patch is transferred on the first intermediate transfer belt 25*a*. The reference patches are detected by the position sensor 62*a*.

In order to detect both reference patches by means of the single position sensor 62*a*, the timing of forming the reference patch on the second photosensitive drum 21*b* is delayed by a prescribed time from the first photosensitive drum 21*a*.

In this apparatus, like the first embodiment, the rotary period of the intermediate transfer belt 25*a*, 25*b* is measured. The rotary period is compared with a reference period (reference value). On the basis of a difference therebetween, the rotary speed of the driving roll 32*a*, 32*b* is adjusted.

In accordance with this embodiment, in addition to making the writing timings in the photosensitive drums 21*a* and 21*b* simultaneously in a symmetrical configuration of the first and the second image forming units 20*a* and 20*b*, by performing the control described above, coincidence could be realized between the tip positions of the images on the front and back sides of the sheet P and image magnifications on both sides.

Provision of the single position sensor permits the production cost to be reduced. Since there is no error of attachment position in the first and the second position sensor 62*a* and 62*b*, the detection accuracy can be improved.

In this embodiment, a system of controlling the exposure devices 23*a* and 23*b* (indicated by a phantom line in FIG. 8), which is adopted in the second embodiment, can be also adopted. Combination of such a system with the control of the rotary period of the driving roll 32*a*, 32*b* is more preferable.

[Fourth Embodiment]

Figure 9:
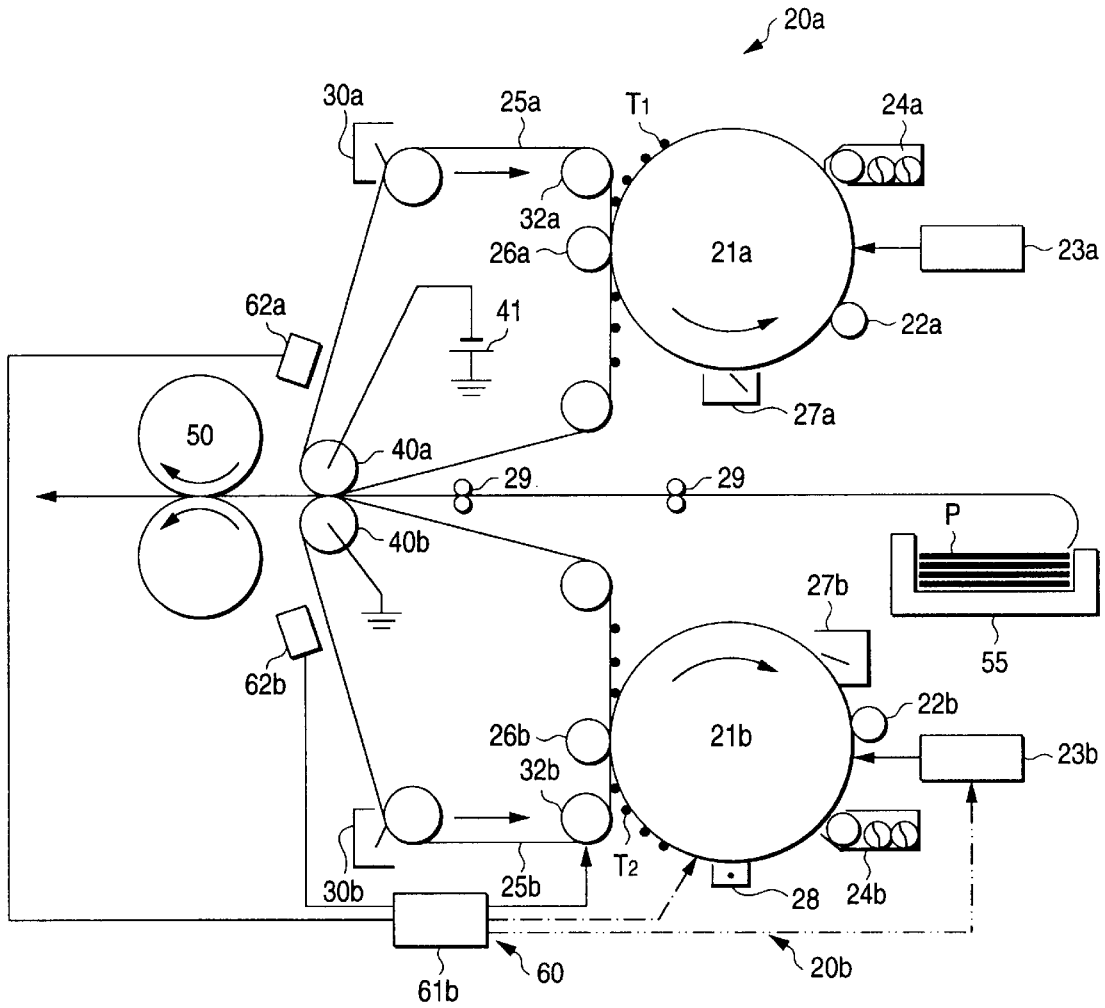
FIG. 9 is a schematic arrangement view showing a double-sided image forming apparatus according to a fourth embodiment.

FIG. 9 shows a schematic configuration of the fourth embodiment of the double-sided image forming apparatus to which the present invention is applied.

Figure 10:
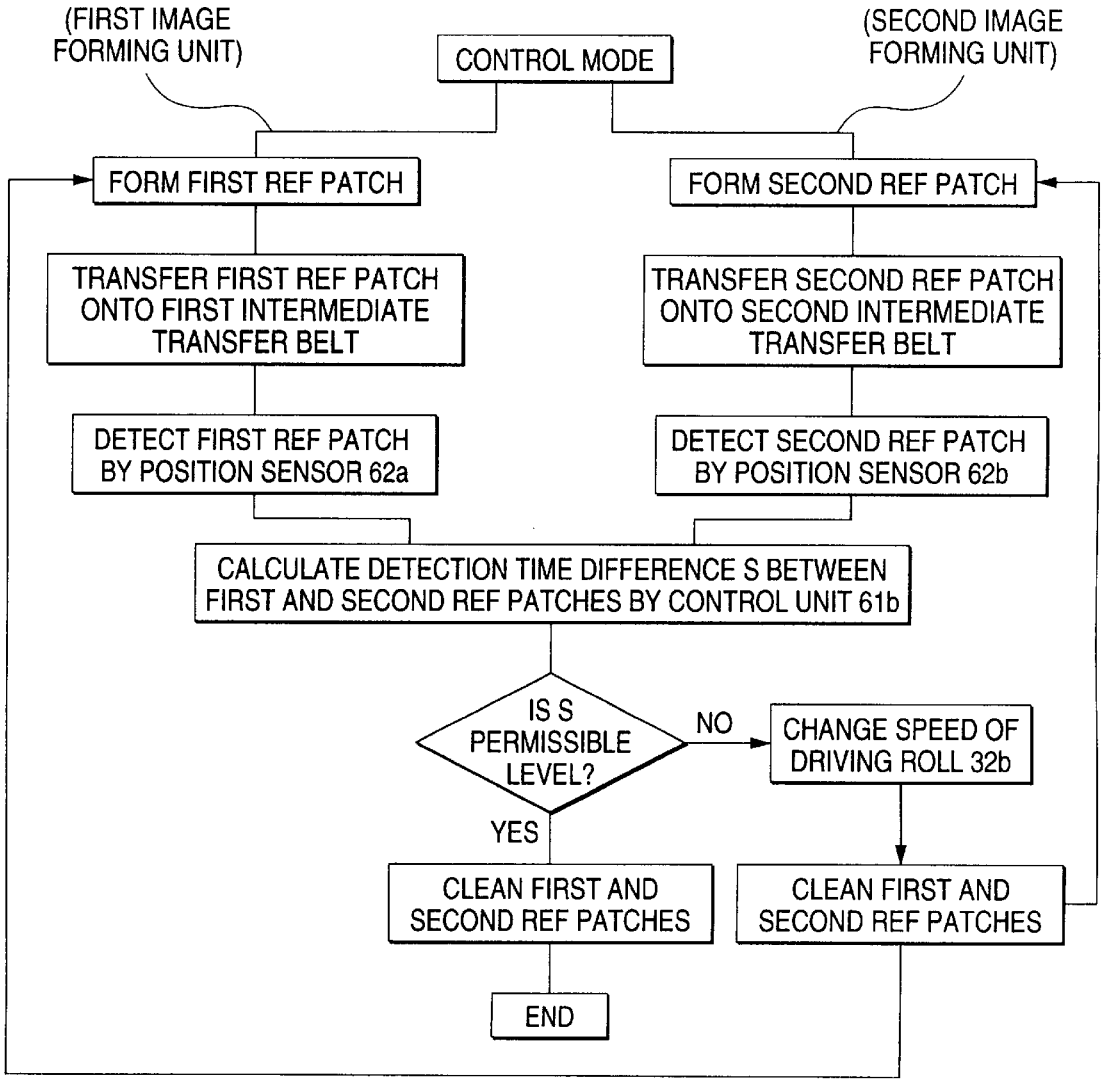
FIG. 10 is a flowchart showing specific control contents of a double-sided image forming apparatus according to the fourth embodiment.

In FIG. 9, the basic configuration of the double-sided image forming apparatus is substantially the same as in the first embodiment. However, unlike the first embodiment, in this embodiment, the image position adjusting apparatus 60 executes the control mode shown in FIG. 10 to fetch the detection result by the position sensor 62*a*, 62*b* into the control part 61*b* so that only the second image forming unit 20*b* is controlled.

In this embodiment, the control mode will be executed as follows.

A reference patch is formed on the photosensitive drum 21*a*, 21*b*, and transferred onto the intermediate belt 25*a*, 25*b*. The reference patch is detected by the position sensor 62*a*, 62*b*. With reference to the detection signal of the reference patch of the first intermediate transfer belt 25*a*, a phase difference S (difference in detection time) of the detection signal of the reference patch on the second intermediate transfer belt 25*b* is measured. On the basis of the phase difference S, the rotary speed of the driving roll 32*a* of the second intermediate transfer belt 25*b* is adjusted.

When the phase difference S becomes a permissible level, the reference patch is cleaned by a belt cleaner 30*a*, 30*b*.

In accordance with this embodiment, in addition to making the writing timings in the photosensitive drums 21*a* and 21*b* simultaneously in a symmetrical configuration of the first and the second image forming unit 20*a* and 20*b*, by performing the control described above, coincidence could be realized between the tip positions of the images on the front and back sides of the sheet P and image magnifications on both sides.

In this embodiment also, it is needless to say that a reference mark provided on each intermediate transfer belt 25*a*, 25*b* may be used in place of the reference patch. As indicated by a phantom line in FIG. 9, on the basis of the above phase difference, the writing timing of the exposure device 23*b* may be adjusted. The above control may be combined with controlling the rotary period of the driving roll 32*b*. Further, in this embodiment, although two detection signals are compared with each other and only the one image forming unit may be controlled, both image forming units 20*a* and 20*b* may be controlled.

[Fifth Embodiment]

Figure 11:
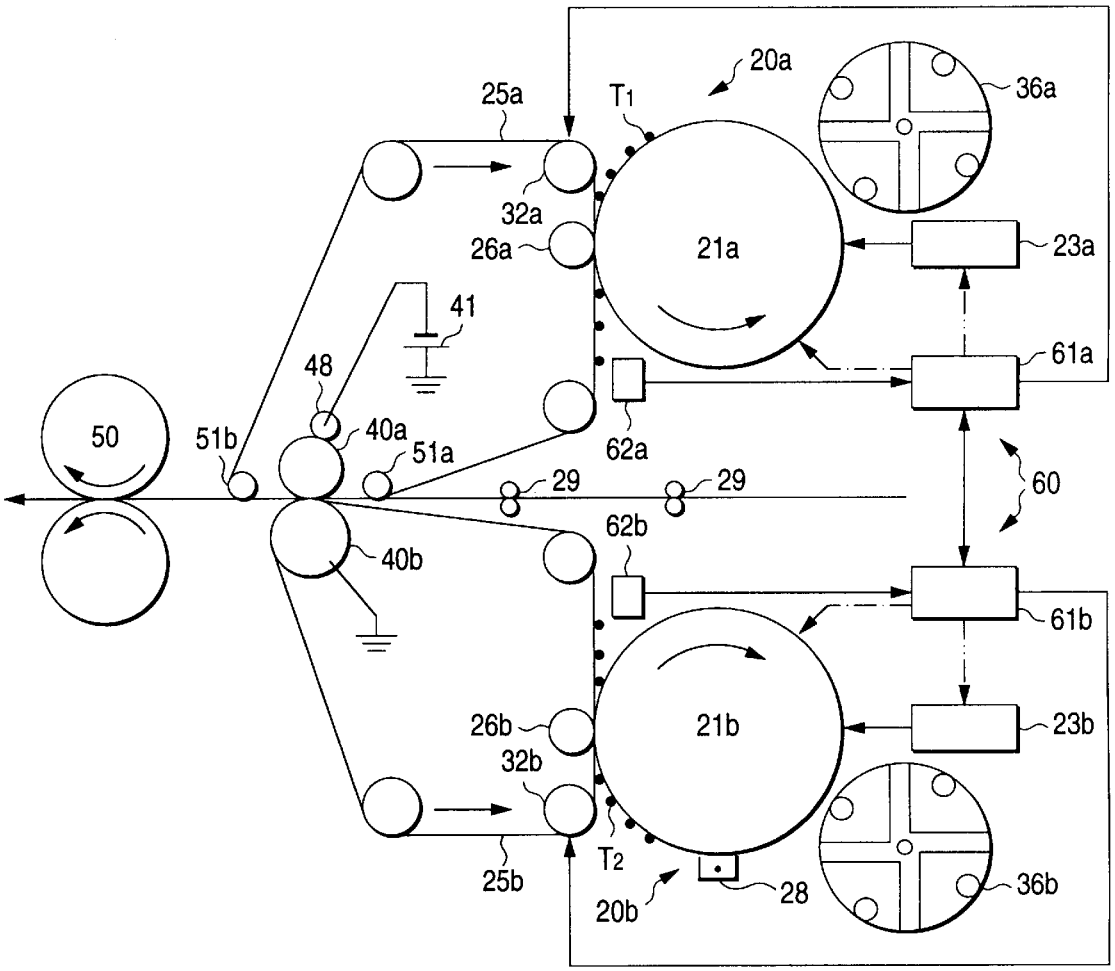
FIG. 11 is a view explaining the details of a contact/separation mechanism according to a fifth embodiment.

FIG. 11 shows a schematic configuration of the fifth embodiment of the double-sided image forming apparatus to which the present invention is applied.

In FIG. 11, the basic configuration of the double-sided image forming apparatus is substantially the same as in the first embodiment. However, unlike the first embodiment, the double-sided image forming apparatus according to this embodiment includes a rotary developing machine 36*a*, 36*b* for full-color (yellow (Y), magenta (M), cyan (C) and black (K)), a contact roll 48 in contact with the secondary transfer roll 40*a* which serves as a bias applying system therefor so that the transfer bias from a bias voltage source 41 is applied to the secondary transfer roll 40*a* through the contact roll 48, and a mechanism (not shown) located between the secondary transfer rolls 40*a* and 40*b*, permitting contact or separation therebetween. Tension rolls 51*a* and 51*b* are arranged on both sides of the secondary transfer roll 40*a*.

The distances from the exposure position to the first transfer position and from the first transfer position to the second transfer position are set to be equal for the first and the second image forming unit 20*a* and 20*b*.

In this embodiment, like the following embodiments, devices around the photosensitive drums 21*a* and 21*b* are not shown.

In this embodiment, the secondary transfer roll 40*a* has a metallic shaft covered with an insulating EPDM rubber and further with a thin film of conductive EPDM rubber to have a surface resistivity of $10^9$ Ω.cm. The contact roll 48 is made of a metallic shaft. The secondary transfer roll 40*b* has a metallic shaft covered with an EPDM rubber containing dispersed carbon blacks to have a volume resistivity of $10^5$ Ω.cm.

The insulating film maybe made of several kinds of rubber and resin having a volume resistivity of $10^{11}$ Ω.cm or more. The conductive thin film may be also made of PVdF, polyester, acrylic etc containing dispersed conductive particles such as carbon blacks to have a preferable surface resistivity of $10^8$–$10^{10}$ Ω/cm$^2$.

The harnesses (Asker C) of the rubber covering the secondary transfer rolls 40*a* and 40*b* was set for 30 degree and 70 degree, respectively. The tension rolls 51*a* and 51*b* were metallic rolls.

In this embodiment, the toner images T1, T2 are formed of negative-charged toners; the primary transfer rolls 26*a*, 26*b* are supplied with a DC current of +10 μA and −10 μA, respectively for each transfer of Y, M, C, and K; a polarity inversion corotron 28 is supplied with a DC current of +300 μA and grid voltage of +500 V; and a contact roll 48 in contact with a secondary transfer roll 40*a* is supplied with −3 kV. A secondary transfer roll 40*b* is connected to ground.

Although the peripheral length of the intermediate transfer belt 25*a*, 25*b* was made twice as long as that of the photosensitive drum 21*a*, 21*b*, in the light of dolor discrepancy, the former is preferably integer-times as long as that of the latter.

Where the exposure device 23*a*, 23*b* is a device (ROS) with a semiconductor laser used as a scanning optical system, the rotation period of the photosensitive drum 21*a*, 21*b* and intermediate transfer belt 25*a*, 25*b* is set to be preferably integer-times as long as the scanning period of an exposure beam, and preferably integer-times as long as the rotation period of the driving gear of the photosensitive drum 21*a*, 21*b* and intermediate transfer belt 25*a*, 25*b*.

The image position adjusting device 60 includes a control part 61*a*, 61*b* and a position sensor 62*a*, 62*b*. The control part 61*a*, 61*b* serves to control the driving roll 32*a*, 32*b* of each intermediate transfer belt 25*a*, 25*b* on the basis of the position information of a reference patch formed on the intermediate transfer belt 25*a*, 25*b*. The position sensor 62*a*, 62*b* serves to detect the reference patch formed on the intermediate transfer belt 25*a*, 25*b*. The image position adjusting device 60 executes the control mode shown in FIG. 12.

In this embodiment, the position sensors 62*a* and 62*b* are arranged oppositely to the intermediate transfer belt 25*a* and 25*b*, respectively at positions equal from the primary transfer section downstream thereof.

An explanation will be made of a process of forming a double-sided image forming device according to this embodiment.

With the secondary transfer rolls 40*a* and 40*b* being separated from each other, the toner image T1 formed in the order of YMCK on the first, second photosensitive drum 21*a*, 21*b* is sequentially transferred on the first intermediate transfer belt 25*a* by one color for each rotation. Likewise, the second toner image T2 (YMCK) formed on the second photosensitive drum 21*b*, after its polarity is inverted by applying a voltage on a polarity-inverted corotron 28, is sequentially transferred on the second intermediate transfer belt 25*b* by the primary transfer roll 26*b*.

After the third color, i.e. cyan transferred on the intermediate transfer belt 25*a*, 25*b*, passes the secondary transfer section, the secondary transfer rolls 40*a* and 40*b* are brought into contact with each other to transport the sheet P in a timed manner. The toner images T1 and T2 of each color on the intermediate transfer belts 25*a* and 25*b* are simultaneously transferred on both surfaces of the sheet P and simultaneously fixed on both surfaces by the fixer 50.

As described above, the YMCK toner images T1 and T2 are transferred superposedly from the photosensitive drums 21*a* and 21*b* to the intermediate transfer belts 25*a* and 25*b*, the sheet P is transported to between the intermediate transfer belts 25*a* and 25*b*, the images on the intermediate transfer belts 25*a* and 25*b* are transferred on both surfaces of the sheet P by the application of an electric field between the secondary transfer rolls 40*a* and 40*b*, and the sheet, as it is, is transported horizontally to the fixer 50 so that the images are fixed simultaneously for both surfaces of the sheet. In this way, the double-sided color image can be obtained at the same recording time as in the single-sided recording.

In this embodiment, the control mode by the image position adjusting device 60 is executed as follows.

Figure 12:
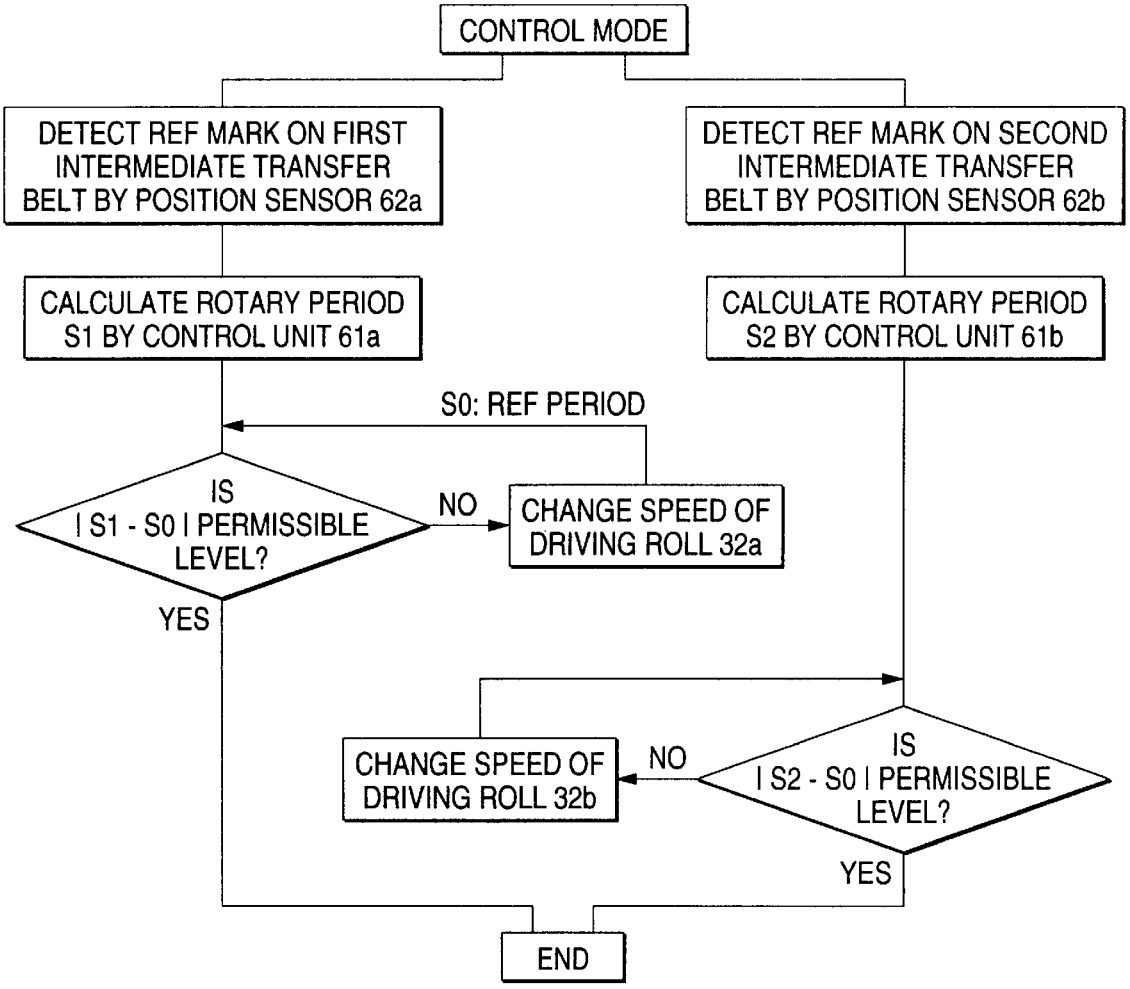
FIG. 12 is a flowchart showing specific control contents of a double-sided image forming apparatus according to the fifth embodiment.

As shown in FIG. 12, reference marks, which have been previously formed on the first and the second intermediate transfer belts 25*a* and 25*b*, are detected by the position sensors 62*a* and 62*b*, respectively. The rotation periods S1 and S2 of the intermediate transfer belts 25*a* and 25*b* are measured, and compared with a prescribed reference period (reference value) S0. On the basis of the differences therebetween, the rotary speed of the driving roll 32*a*, 32*b* is adjusted to be timed to the reference period S0.

Figure 13:
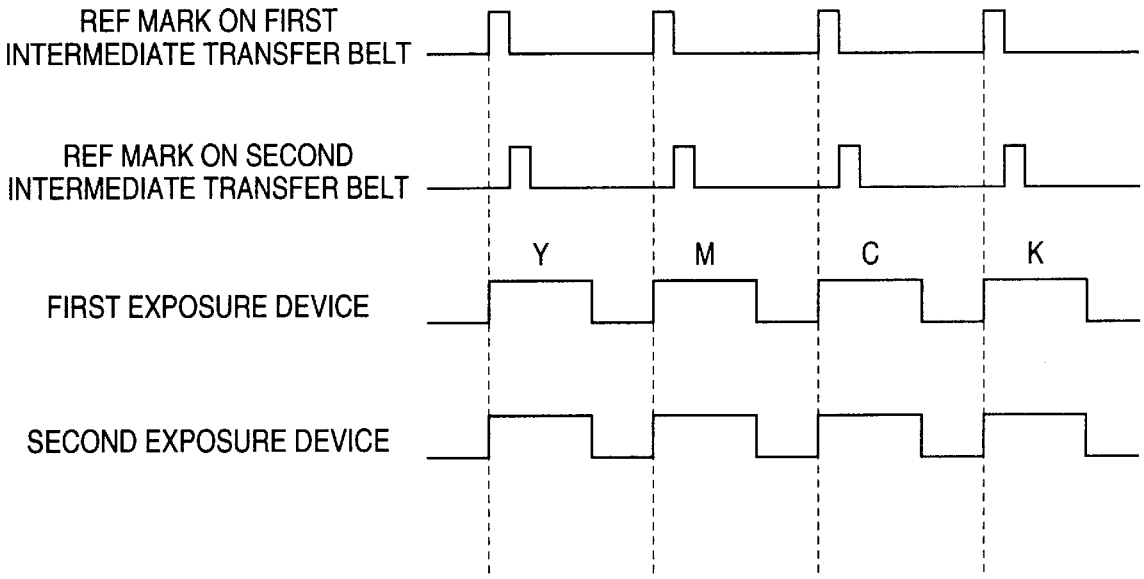
FIG. 13 is a timing chart showing the operation process of a double-sided image forming apparatus according to the fifth embodiment.

When the images are to be formed, as seen from the timing chart of FIG. 13, for example, using, as a reference signal, the timing when the reference mark on the first intermediate transfer belt 25*a* passes the position sensor 62*a*, the first and the second exposure device 23*a* and 23*b* execute their writing.

By performing the control described above, coincidence could be realized between the tip positions of the images on the front and back sides of the sheet P and image magnifications on both sides, and in addition the color images with less color discrepancy could be obtained.

[Sixth Embodiment]

Figure 14:
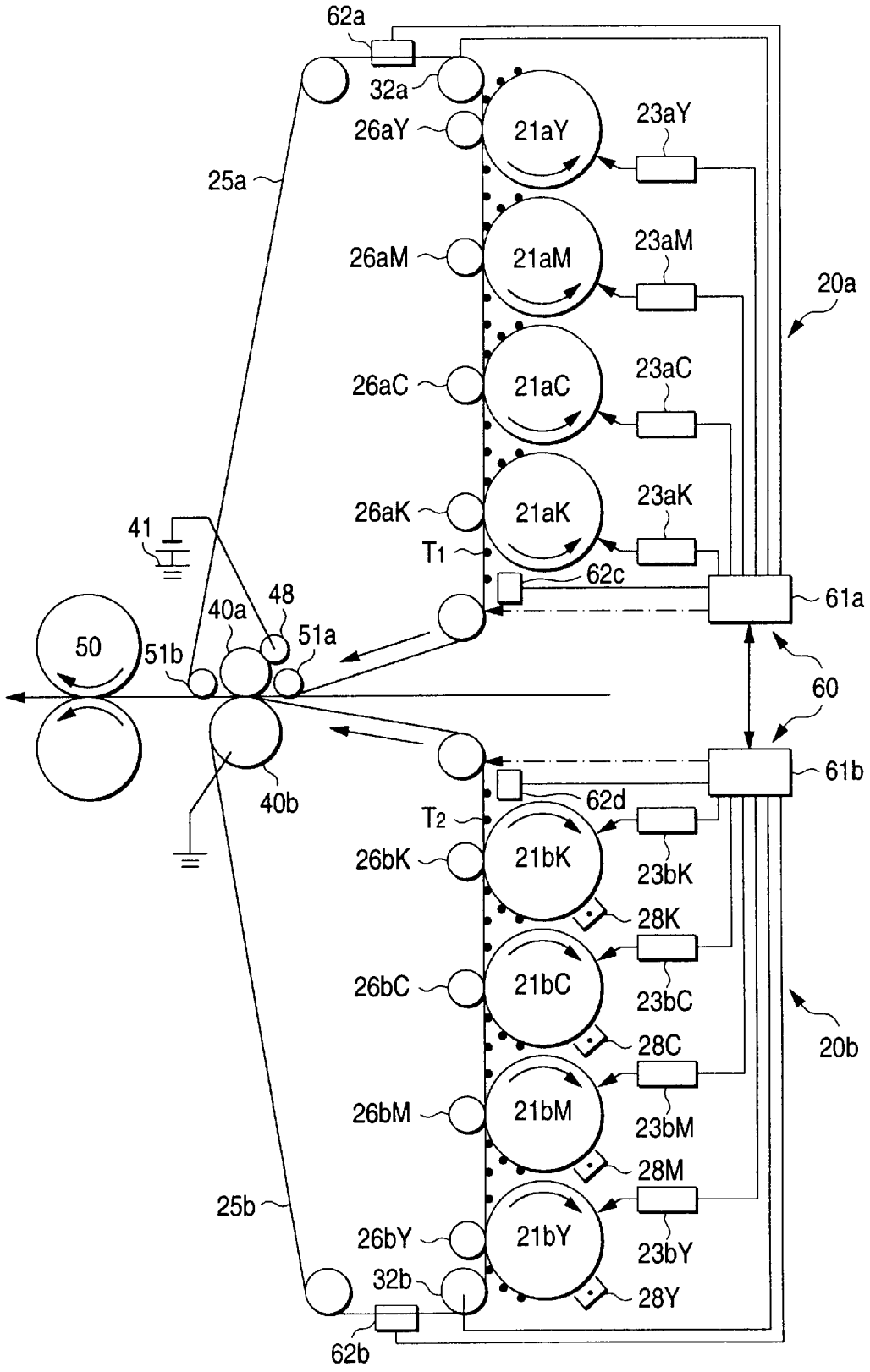
FIG. 14 is a schematic arrangement view showing a double-sided image forming apparatus according to a sixth embodiment.

FIG. 14 shows a schematic configuration of the sixth embodiment of the double-sided image forming apparatus to which the present invention is applied.

In FIG. 14, the basic configuration of the double-sided image forming apparatus is substantially the same as in the fifth embodiment. However, unlike the fifth embodiment, the double-sided image forming apparatus according to this embodiment includes a first groups of photosensitive drums 21*a* for forming Y, M, C and K toner images, respectively (specifically, 21*a*Y, 21*a*M, 21*a*C and 21*a*K), a second groups of photosensitive drums 21*b* (specifically, 21*b*Y, 21*b*M, 21*b*C, 21*a*K), the corresponding primary transfer rolls 26*a* and 26*b* (specifically, 26*a*Y, 26*a*M, 26*a*C, 26*a*K; 26*b*Y, 26*b*M, 26*b*C, 26*b*K), and exposure devices 23*a* and 23*b* (specifically, 23*a*Y, 23*a*M, 23*a*C, 23*a*K; 23*b*Y, 23*b*M, 23*b*C, 23*b*K)

The distances from the exposure position to the first transfer position and from the first transfer position to the second transfer are set to be equal for the first and the second image forming unit 20*a* and 20*b*.

In this embodiment, the toner images T1, T2 are formed of negative-charged toners; the primary transfer rolls 26*a*Y-26*a*K, 26*b*Y-26*b*K are supplied with a DC current of +10 $\mu$A and −10 $\mu$A, respectively for each transfer of Y, M, C, and K; a polarity inversion corotron 28 (specifically, 28Y, 28M, 28C, 28K) is supplied with a DC current of +300 $\mu$A and grid voltage of +500 V; and a contact roll 48 in contact with a secondary transfer roll 40*a* is supplied with DC voltage of −4 kV. A secondary transfer roll 40*b* is connected to ground.

Figure 15:
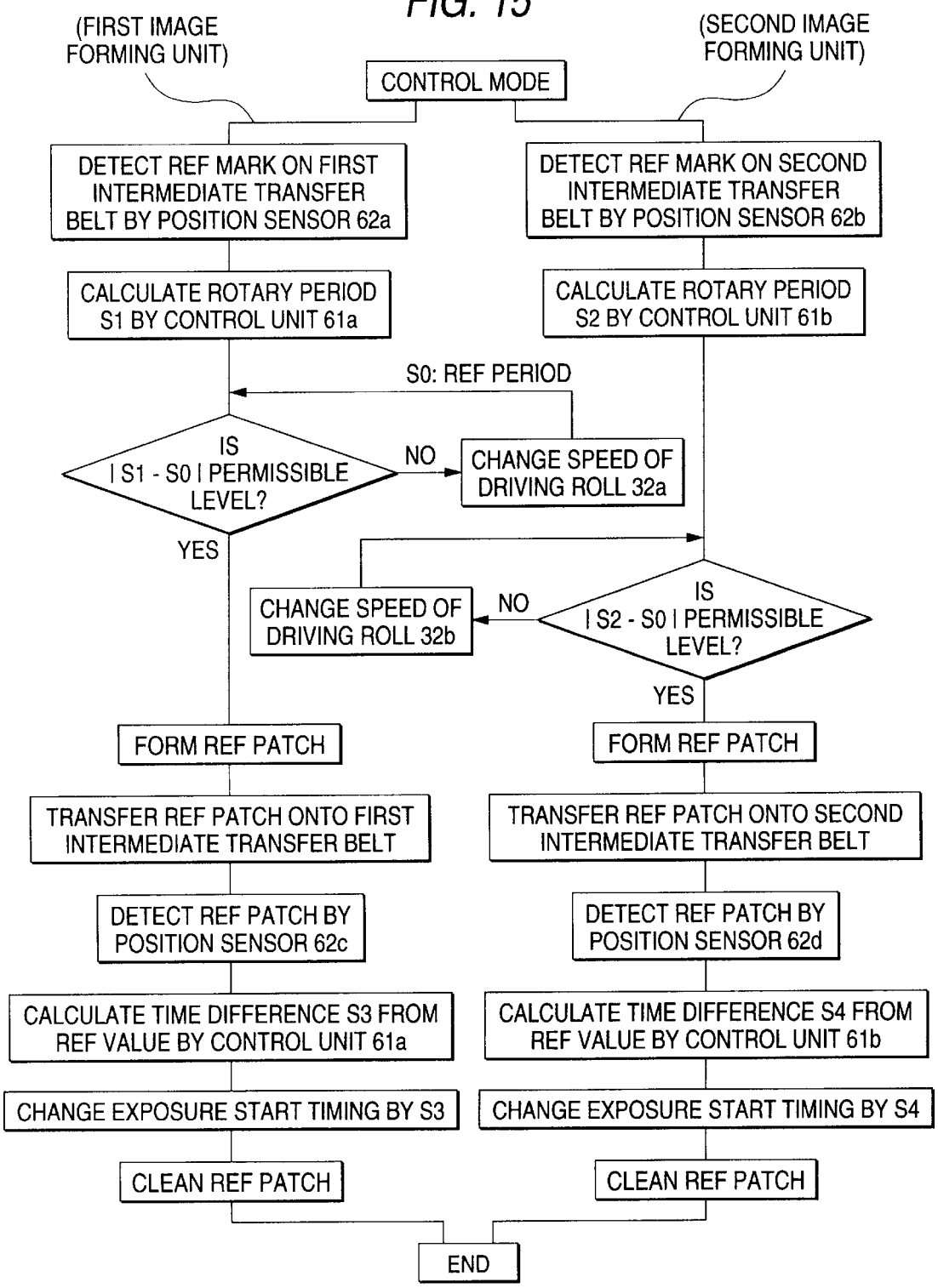
FIG. 15 is a flowchart showing specific control contents of the double-sided image forming apparatus according to the sixth embodiment.

In this embodiment, the image position adjusting device 60 includes a control part 61*a*, 61*b* for executing the control mode shown in FIG. 15, a position sensor 62*a*, 62*b* for detecting a transmissive reference mark arranged upstream of the group of photosensitive drums 21*a*, 21*b*, and a position sensor 62*c*, 62*d* for detecting a reflective reference patch arranged downstream of the group of photosensitive drums 21*a*, 21*b*.

An explanation will be made of a process of forming a double-sided image forming device according to the present invention.

The toner image T1 formed in the order of YMCK on the first group of photosensitive drums 21*a*Y, 21*a*M, 21*a*C, 21*a*K is sequentially transferred on the first intermediate transfer belt 25*a* by the primary transfer roll 26*a*Y, 26*a*M, 26*a*C, 26*a*K.

Likewise, the second toner image T2 (YMCK) formed on the second group of drums 21*b*Y, 21*b*M, 21*b*C, 21*b*K, after its polarity is inverted by applying a voltage on a polarity-inverted corotron 28Y-28K, is sequentially transferred on the second intermediate transfer belt 25*b* by the primary transfer roll 26*a*Y, 26*a*M, 26*a*C, 26*a*K.

On the other hand, the sheet P is transported in a timed manner. The toner images T1 and T2 of each color on the intermediate transfer belts 25*a* and 25*b* are simultaneously transferred on both surfaces of the sheet P and simultaneously fixed on both surfaces by the fixer 50.

As described above, the YMCK toner images T1 and T2 are transferred superposedly from the photosensitive drums 21*a* (21*a*Y-21*a*K) and 21*b* (21*b*Y-21*b*K) to the intermediate transfer belts 25*a* and 25*b*, the sheet P is transported between the intermediate transfer belts 25*a* and 25*b*, the images on the intermediate transfer belts 25*a* and 25*b* are transferred on both surfaces of the sheet P by the application of an electric field between the secondary transfer rolls 40*a* and 40*b*, and the sheet, as it is, is transported horizontally to the fixer 50 so that the images are fixed simultaneously for both surfaces of the sheet. In this way, the double-sided color image can be obtained at the same recording time as in the single-sided recording.

Figure 16:
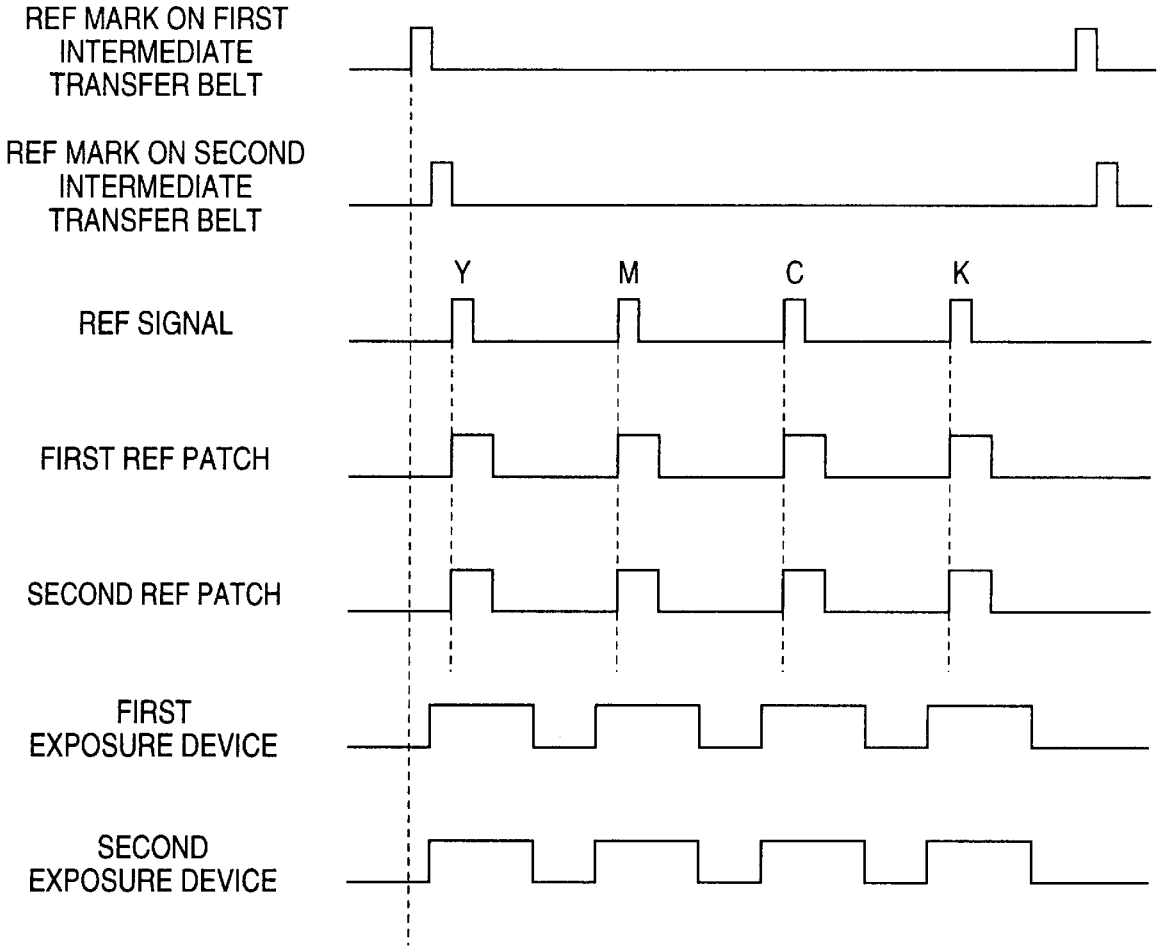
FIG. 16 is a timing chart showing the operation process of the double-sided image forming apparatus according to the sixth embodiment.
Figure 17:
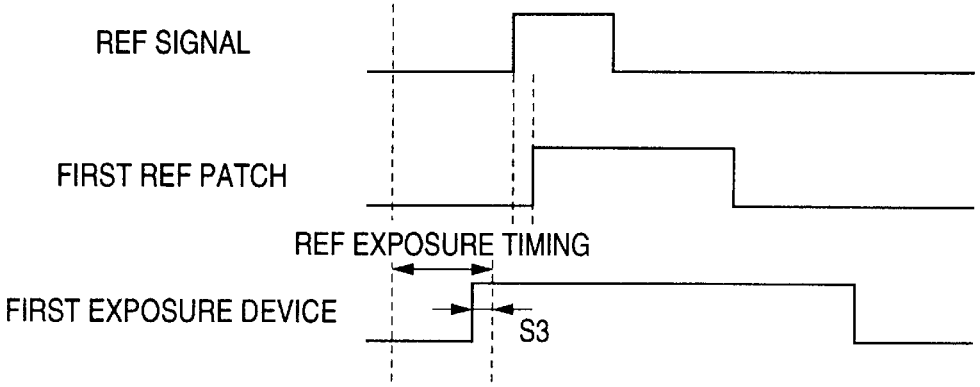
FIG. 17 is a partially enlarged view of FIG. 16.

In this embodiment, the control mode by the image position adjusting device 60 is executed in the process as shown in FIG. 15. The timing chart thereof is shown in FIG. 16 and the main part thereof is shown in an enlarged manner as shown in FIG. 17.

As shown in FIG. 15, reference marks, which have been previously formed on the first and the second intermediate transfer belts 25*a* and 25*b*, are detected by the position sensors 62*a* and 62*b*, respectively. The rotation periods S1 and S2 of the intermediate transfer belts 25*a* and 25*b* are measured, and compared with a prescribed reference period (reference value) S0. On the basis of the differences therebetween, the rotary speed of the driving roll 32*a*, 32*b* is adjusted to be timed to the reference period S0.

Subsequently, reference patches for YMCK are formed on the photosensitive drums 21*a* and 21*b* using, as a reference signal, the timing when the reference mark on the first intermediate transfer belt 25*a* passes the position sensor 62*a*. The positions and length in the direction of process of the reference patches are detected by the position sensors 62*c* and 62*d*.

The detected values are compared with the prescribed reference value. On the basis of the time difference S3, S4, the light-emitting timing (exposure timing) of the laser in the exposure device 23*a*, 23*b* is controlled (FIGS. 16 and 17).

When the processing of changing the timing of exposure start for the exposure device 23*a*, 23*b* is completed, the reference patch is cleaned by each belt cleaner 30*a*, 30*b*.

In accordance with this embodiment, by performing the control described above, coincidence could be realized between the tip positions of the images on the front and back sides of the sheet P and image magnifications on both sides, and in addition the color images with less color discrepancy could be obtained.

[Seventh Embodiment]

Figure 18:
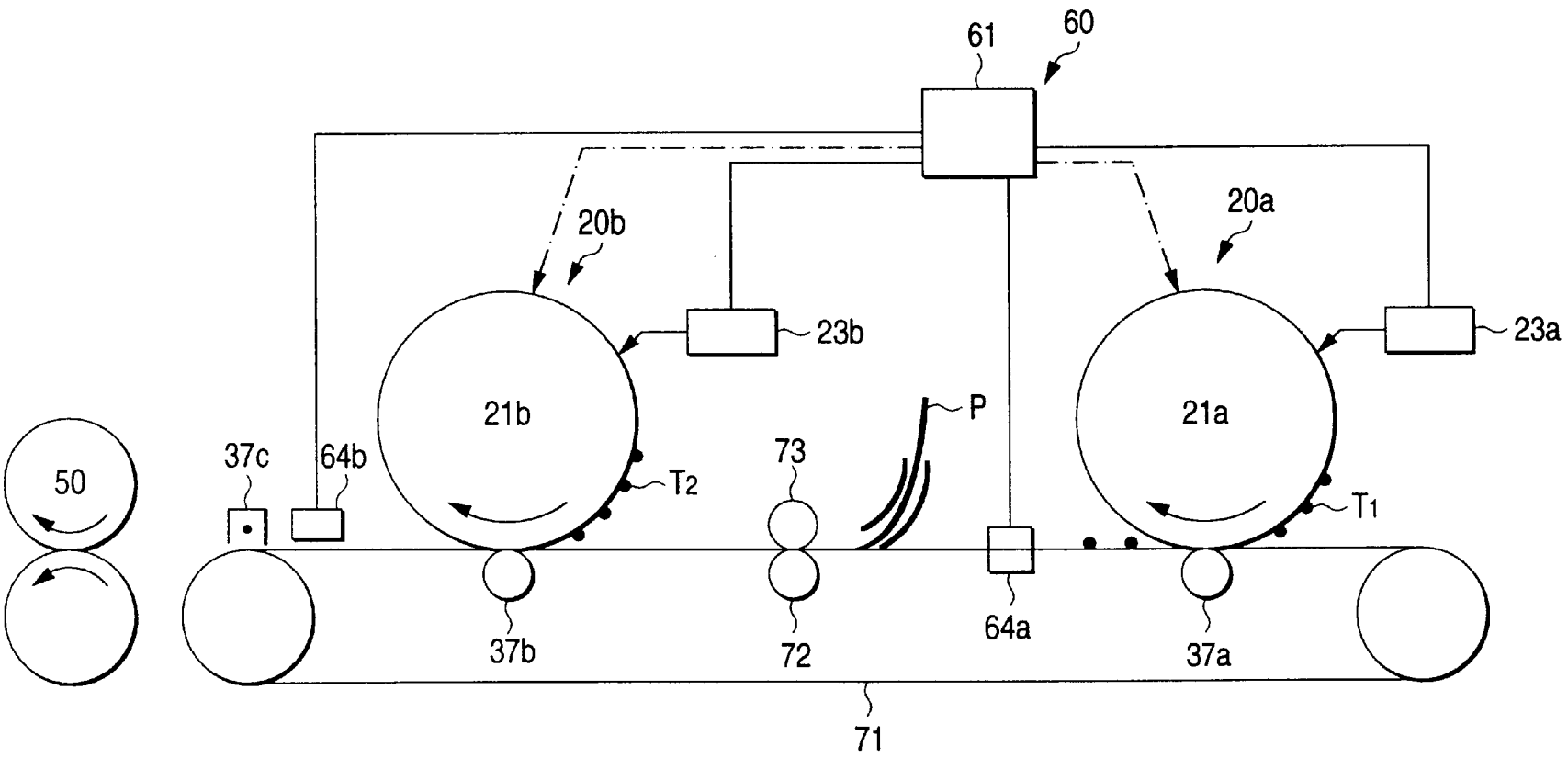
FIG. 18 is a schematic arrangement view showing a double-sided image forming apparatus according to a seventh embodiment.

FIG. 18 shows a schematic configuration of the seventh embodiment of the double-sided image forming apparatus to which the present invention is applied.

In FIG. 18, the basic configuration of the double-sided image forming apparatus according to this embodiment includes a first image forming unit 20*a* (in which devices for electrophotography inclusive of an exposure device 23*a* and first transfer roll 37*a* are arranged around a photosensitive drum 21*a*), a second image forming unit 20*b* (in which devices for electrophotography inclusive of an exposure device 23*b* and second transfer roll 37*b* are arranged around a photosensitive drum 21*b*), and an intermediate transfer and carrier belt 71 on which transfer areas of the first and the second image forming unit 20*a* and 20*b* are arranged oppositely.

In this embodiment, the first transfer roll 37*a* serves to transfer the first toner image T1 on the photosensitive drum 21*a* onto the intermediate transfer and carrier belt 71 (primary transfer), whereas the second transfer roll 37*b* serves to transfer the second toner image T2 on the photosensitive drum 21*b* onto a sheet P on the intermediate transfer and carrier belt 71.

On the intermediate transfer and carrier belt 71, on the way from the transfer area of the first image forming unit 20*a* to that of the second image forming unit 20*b*, sheet adsorption rolls 72 and 73 are provided which serve to adsorb the sheet P fed from a feeding section (not shown) electrostatically.

Reference numeral 37*c* designates a third transferring corotron for transferring the first toner image T1 transferred on the intermediate transfer and carrier belt 71 onto the sheet P (second transfer). Reference numeral 50 designates a fixer for fixing the non-fixed toner image on the sheet P.

In this embodiment, the toner images T1, T2 are formed of negative-charged toners; the primary transfer rolls 37*a* and 37*b* are supplied with a DC current of +10 $\mu$A, respectively; the third transferring corotron 37*c* is supplied with a DC current of +400 $\mu$A; and the one sheet adsorption roll 72 is supplied with a DC current of +10 $\mu$A whereas the other sheet adsorption roll 73 is connected to ground.

Figure 19:
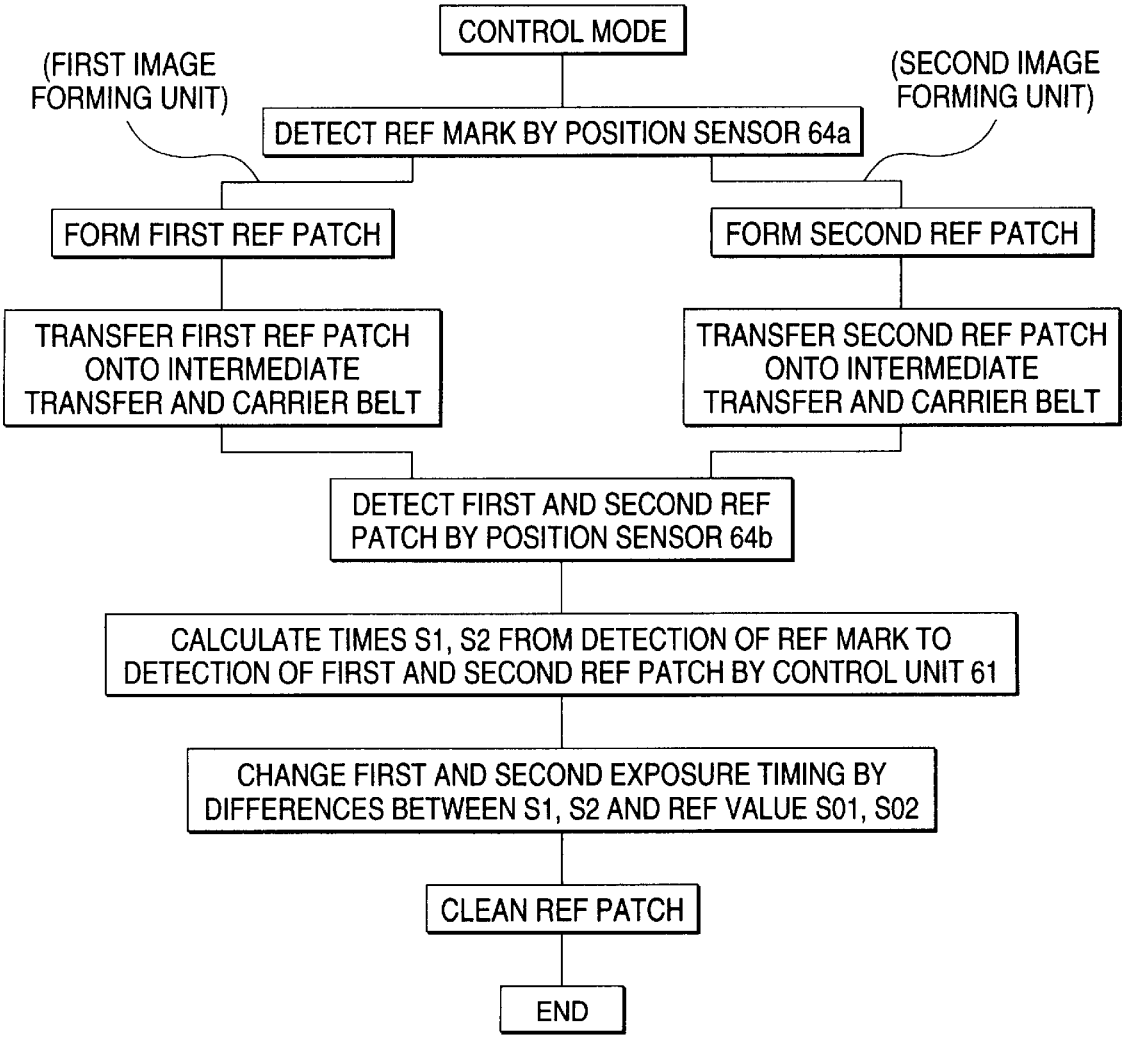
FIG. 19 is a flowchart showing specific control contents of the double-sided image forming apparatus according to the seventh embodiment.

Further, in this embodiment, the image position adjusting apparatus 60 includes a control part 61 for executing the control mode shown in FIG. 19, a position sensor 64*a* for detecting the reference mark on the intermediate transfer and carrier belt 71 and another position sensor 64*b* for detecting the reference patch formed on the intermediate transfer and carrier belt 71. The control part 61 controls, on the basis of the detection results from the position sensors 62*a* and 62*b*, the rotary speed of the intermediate transfer and carrier belt 71 and the writing timings of the exposure devices 23*a* and 23*b*.

An explanation will be made of a process of forming a double-sided image forming device according to this embodiment.

The first toner image T1 is formed on the first photosensitive drum 21*a* and transferred on the intermediate transfer and carrier belt 71 by the first transfer roll 37*a*.

The sheet P is transported in a timed manner and adsorbed on the intermediate transfer and carrier belt 71 by the sheet adsorption rolls 72 and 73 from above the first toner image T1.

Subsequently, the second toner image T2 is formed on the second photosensitive drum 21*b* and transferred on the sheet P by the second transfer roll 37*b*. Therefore, the first toner image T1 is transferred from the intermediate transfer and carrier belt 71 onto the sheet P by the third transfer corotron 37*c* arranged at a sheet exhaust end of the intermediate transfer and carrier belt 71. The images transferred on both surfaces of the sheet P are fixed simultaneously for-both sides by the fixer 50.

As described above, the sheet P is overlaid on the first toner image T1 transferred on the intermediate transfer and carrier belt 71 from the first photosensitive drum 21*a*, the second toner image T2 is transferred on the sheet P from the second photosensitive drum 21*b*, and first toner image T1 is also transferred on the sheet P. The sheet P, as it is, is transported horizontally to the fixer 50 so that the images are fixed simultaneously for both surfaces of the sheet. In this way, the double-sided color image can be obtained at the same recording time as in the single-sided recording.

Figure 20:
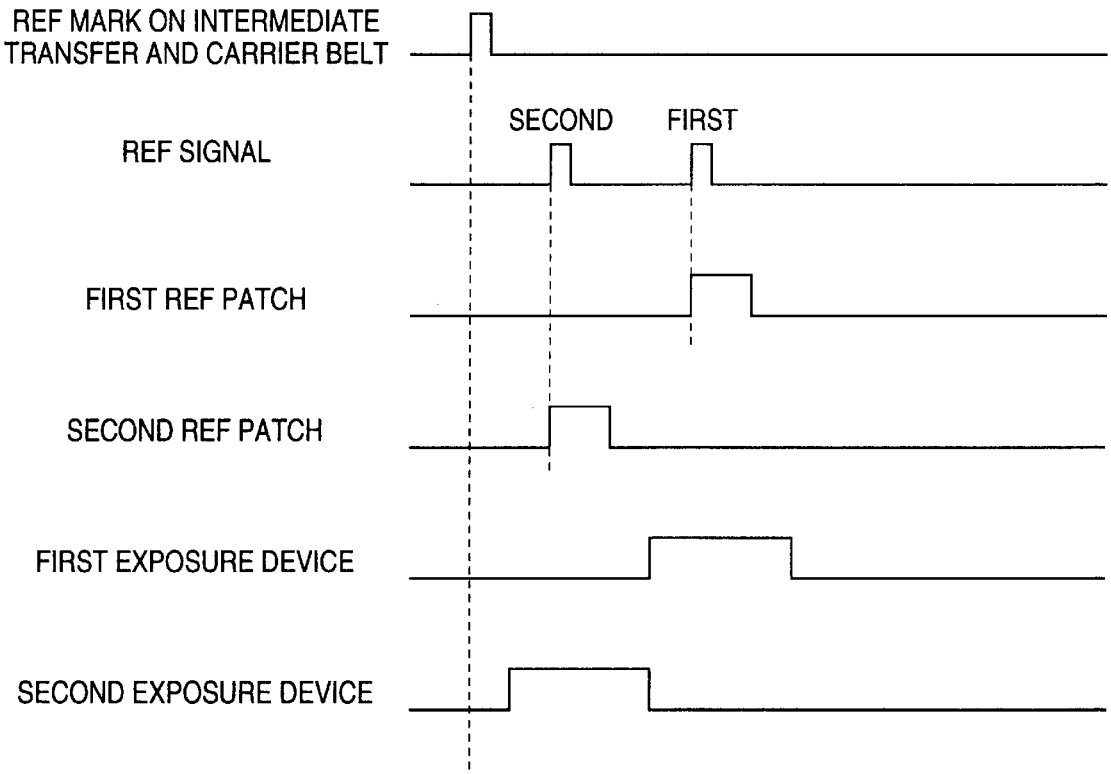
FIG. 20 is a timing chart showing the operation process of the double-sided image forming apparatus according to the seventh embodiment.

In this embodiment, the control mode by the image position adjusting device 60 will be executed as shown in FIG. 19. The timing chart during the execution of the control mode is shown in FIG. 20.

In the control mode, reference patches are formed on the photosensitive drums 21*a* and 21*b* using, as a reference signal, the timing when the reference mark on the intermediate transfer and carrier belt 71 passes the position sensor 64*a*. The positions and length in the direction of process of the reference patches are detected by the position sensors 64*b*. At this time, the sheet P is not transported.

The detected values (times S1 and S2 elapsed from detection of the reference mark to the detection of the first and the second reference patch) are compared with the prescribed reference values (S01, S02). On the basis of the time differences (S1–S01, S2–S02), the light-emitting timings (exposure timing) of the lasers in the exposure devices 23*a* and 23*b* are controlled.

At the time when the exposure start timing in the exposure device 23*a*, 23*b* is changed, the reference patches are cleaned by the belt cleaner (not shown).

In accordance with this embodiment, by performing the control described above, coincidence could be realized between the tip positions of the images on the front and back sides of the sheet P and image magnifications on both sides.

In this embodiment, the detection results were compared with the prescribed reference values so as to control the light emitting timings of the lasers in the exposure devices 23*a* and 23*b*. One or both of the exposure devices 23*a* and 23*b* may be controlled on the basis of the relative positions of the first and second reference patches.

In this embodiment, the first toner image T1 was transferred from the intermediate transfer and carrier belt 71 onto the sheet P by the third transferring corotron 37*c*. However, without being limited to such a means, if the first and the second toner images T1 and T2 are caused to have opposite polarities at the second transferring position by, for example, inverting the charging polarity of the first toner image T1 upstream of the second transfer position or using toners having different polarities, the images can be simultaneously transferred on both surfaces of the sheet P.

A modification of this embodiment can be proposed as an apparatus including a single photosensitive drum 21*a* and an intermediate transfer and carrier belt 71 in which after the first toner image T1 is transferred on the intermediate transfer and carrier belt 71 during the first rotation of the photosensitive drum 21*a*, the sheet P is overlaid on the belt, the second toner image T2 is transferred onto the sheet P during the second rotation of the photosensitive drum 21*a* and thereafter the first toner image T1 is transferred on the sheet P to provide the double-sided image thereon. In such an apparatus also, by performing the same control, coincidence can be realized between the tip positions of the images on the front and back sides of the sheet P and image magnifications on both sides.

[Eighth Embodiment]

Figure 21:
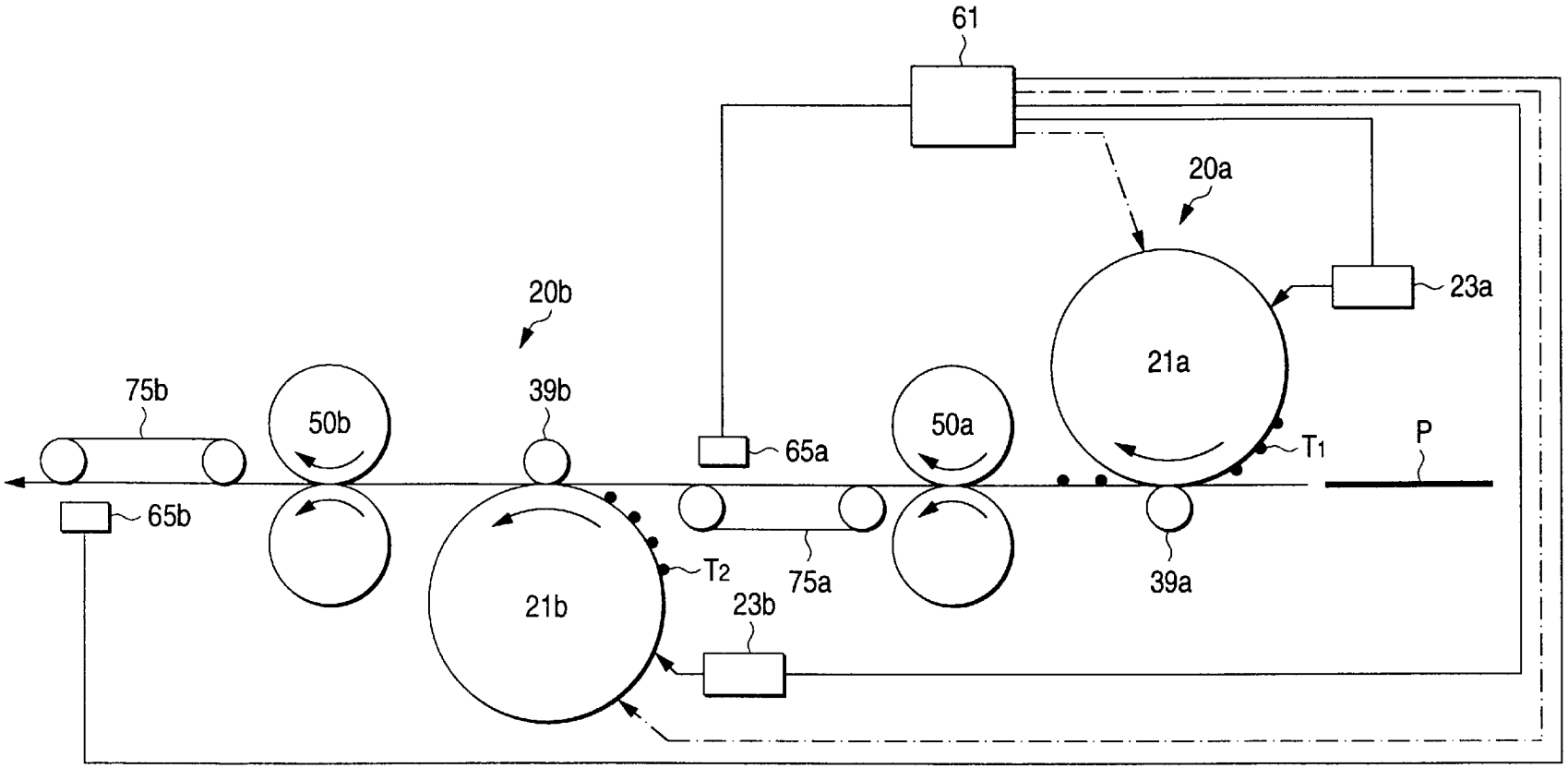
FIG. 21 is a schematic arrangement view showing a double-sided image forming apparatus according to an eighth embodiment.

FIG. 21 shows a schematic configuration of the eighth embodiment of the double-sided image forming apparatus to which the present invention is applied.

In FIG. 21, the double-sided image forming apparatus according to this embodiment includes a first image forming unit 20*a* (in which devices for electrophotography inclusive of an exposure device 23*a* and transfer roll 39*a* are arranged around a photosensitive drum 21*a*), a second image forming unit 20*b* (in which devices for electrophotography inclusive of an exposure device 23*b* and transfer roll 37*b* are arranged around a photosensitive drum 21*b*), fixers 50*a* and 50*b* which are arranged behind the image forming units 20*a* and 20*b*, respectively, and carrier belts 75*a* and 75*b* for carrying the sheet P while adsorbing it, which are arranged downstream of the fixers 50*a* and 50*b*, respectively.

In this embodiment, the toners T1 and T2 are negative-charged toners, and the transfer rolls 26*a* and 26*b* are supplied with a DC current of 10 $\mu$A.

In this embodiment, the image position adjusting device 60 includes a control part 61 for executing the control mode shown in FIG. 21 and position sensor 65*a*, 65*b* for detecting the reference patch formed on the sheet P and controls the writing timing of the exposure device 23*a*, 23*b* on the basis of the detection result by the position sensor 65*a*, 65*b*.

An explanation will be made of a process of forming a double-sided image forming device according to the present invention.

The first toner image T1 formed on the first photosensitive drum 21*a* is transferred onto the sheet by the transfer roll 39*a* and fixed by the fixer 50*a*.

After the sheet P is transported from the first image forming unit 20*a* to the second image forming unit 20*b* by the transportation belt 75*a*. Like the first image forming unit 20*a*, the second toner image T2 is transferred on the back side of the sheet P by the transfer roll 39*b* and fixed by the fixer 50*b*. In this way, the double-sided color image can be obtained at the same recording time as in the single-sided recording.

Figure 22:
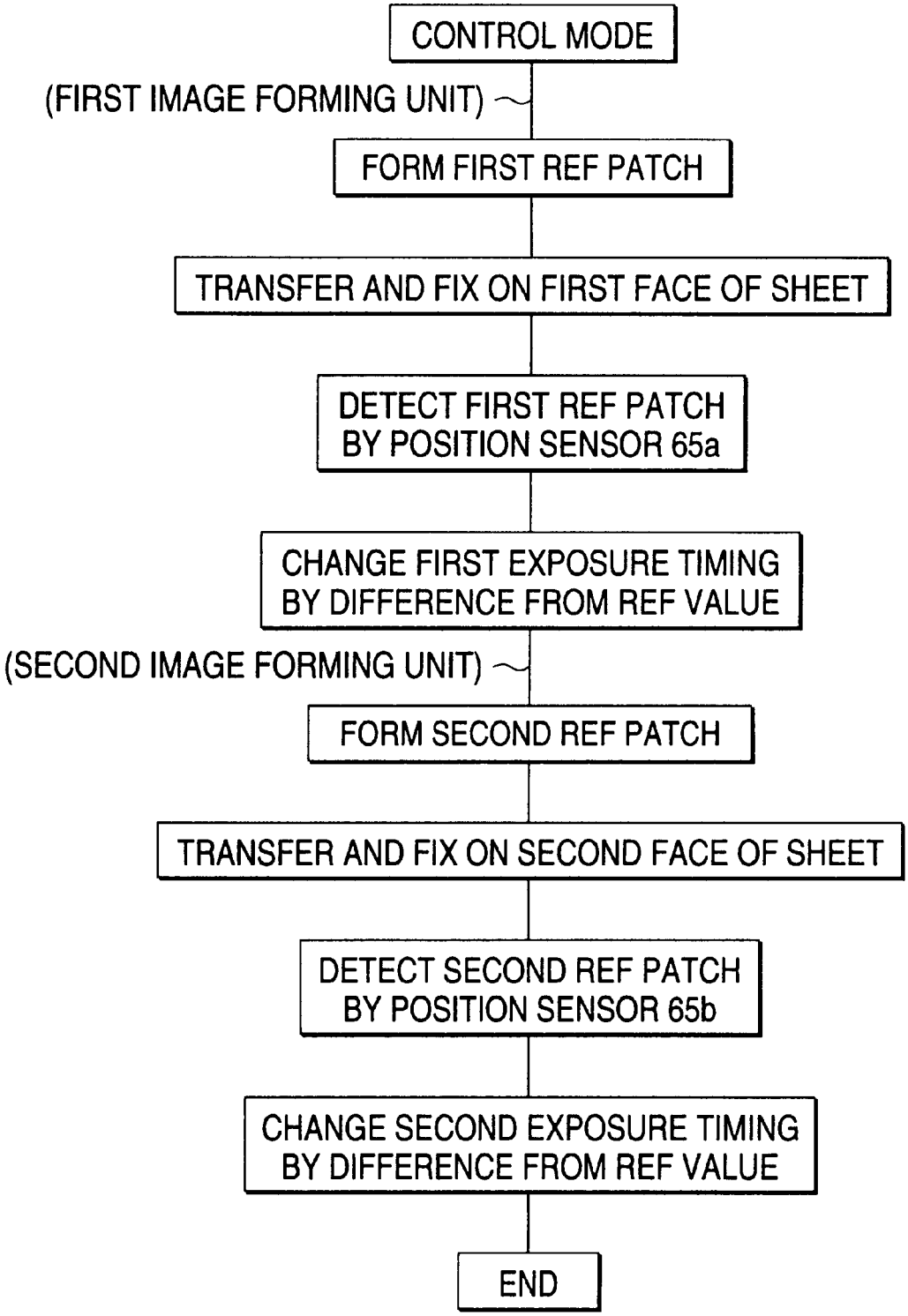
FIG. 22 is a flowchart showing specific control contents of the double-sided image forming apparatus according to the eighth embodiment.

In this embodiment, the control mode by the image position adjusting device 60 will be executed as shown in FIG. 22.

In the control mode, reference patches are formed in the first and second image forming units 20*a* and 20*b*, respectively, and transferred on the sheet. The positions and lengths in the direction of process from the tip end of the reference patches are detected by the position sensors 65*a* and 65*b* which are arranged the carrier belts 75*a* and 75*b*, respectively.

The detected results are compared with the prescribed reference values. On the basis of the time differences, the light-emitting timings (exposure timing) of the laser in the exposure devices 23*a* and 23*b* are-controlled.

In accordance with this embodiment, by performing the control described above, coincidence could be realized between the tip positions of the images on the front and back sides of the sheet P and image magnifications on both sides.

In this embodiment, the detection results are compared with the prescribed reference values so as to control the light emitting timings of the lasers in the exposure devices 23*a* and 23*b*. One or both of the exposure devices 23*a* and 23*b* may be controlled on the basis of the relative positions of the first and second reference patches.

In addition, assuming that the sheet is located in a stabilized profile, the position sensors 65*a* and 65*b* may be arranged on both sides of the sheet carrying passage in front of the fixer 50*a*, 50*b* or downstream of the second fixer 50*b*.

As described above, in accordance with the present invention, since the positions of the images formed on both front and back surfaces of a recording medium by two image forming units are matched with each other, discrepancy could be reduced between the tip positions of the images on the front and back surfaces of the sheet P and image magnifications on both sides, and in addition, the color discrepancy between the color images can be reduced.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modifications may be made thereto without departing from the spirit and scope of the invention.

What is claimed is:

1. A double-sided image forming apparatus comprising:

two image forming units for forming images on both front and back surfaces of a recording medium;

image position adjusting means for matching the positions of the images formed on both the front and back surfaces of the recording medium by the two image forming units.

2. A double-sided image forming apparatus according to claim 1, wherein said image position adjusting means at least matches the positions from the tip of the recording medium of the images formed on both front and back surfaces of the recording medium using by the two image forming units.

3. A double-sided image forming apparatus according to claim 1, wherein said image position adjusting means at least matches the magnification factors of the images formed on both front and back surfaces of the recording medium by the two image forming units.

4. A double-sided image forming apparatus according to claim 1, wherein said image position adjusting means matches the positions from the tip of the recording medium and magnification factors of the images formed on both front and back surfaces of the recording medium by the two image forming units.

5. A double-sided image forming apparatus according to claim 1, wherein the image position adjusting means matches the timings of forming the images by the image forming units with the same reference value.

6. A double-sided image forming apparatus according to claim 1, wherein the image position adjusting means matches the timing of forming an image by the one image forming unit with that of forming an image by the other image forming unit.

7. A double-sided image forming apparatus according to claim 1, wherein the image position adjusting means makes reference patches on image carriers respectively provided for the image forming units, and on the basis of detection results of the reference patches by detecting means, matches the positions of the images formed on both the front and back surfaces of the recording medium by the two image forming units.

8. A double-sided image forming apparatus according to claim 1, wherein the image position adjusting means makes reference marks on image carriers respectively provided for the image forming units, and on the basis of detection results of the reference marks by detecting means, matches the positions of said images formed on both front and back surfaces of the recording medium by the two image crating units.

9. A double-sided image forming apparatus according to claim 1, said image forming units include a first image carrier carrying a first image;

a first intermediate transfer unit arranged oppositely to the first image carrier;

a first intermediate primary transferring means for primary transferring the first image on the first image carrier onto the first intermediate transfer unit;

a second carrier carrying a second image;

a second intermediate transfer unit arranged oppositely to the second image carrier;

a second intermediate primary transferring means for primary transferring the second image on the second image carrier onto the second intermediate transfer unit; and an intermediate secondary transferring means for secondary transferring the images formed on the first and second intermediate transfer units by the primary transfer onto both surfaces of the recording medium.

10. A double-sided image forming apparatus according to claim 9, wherein the image position adjusting means makes reference patches on said first and second image carriers, transfers the reference patches on the first or second intermediate transfer units, and on the basis of detection results of the reference patches by detecting means, and matches the positions of the images formed on both front and back surfaces of the recording medium by the two image crating units.

11. A double-sided image forming apparatus according to claim 9, wherein the image position adjusting means makes reference marks on the first and second transfer units and on the basis of detection results of the reference marks by detecting means, matches the positions of said images formed on both front and back surfaces of the recording medium by the two image crating units.

12. A double-sided image forming apparatus according to claim 9, wherein the image position adjusting means makes first and second reference patches on the first and second image carriers, transfers the first reference patch on said first intermediate transfer units and the second reference patch on the first intermediate transfer unit through said second intermediate transfer unit, and thereafter on the basis of detection results of the reference patches by detecting means, matches the positions of the images formed on both the front and back surfaces of the recording medium by the two image crating units.

13. A double-sided image forming apparatus according to claim 9, wherein the image position adjusting means controls the driving period of at least the one intermediate transfer unit in the image forming units.

14. A double-sided image forming apparatus according to claim 9, wherein the image position adjusting means controls the timing of writing an image in at least one image carrier in the image forming units.

15. A double-sided image forming apparatus according to claim 9, wherein the first intermediate carrier and the second intermediate carrier are intermediate transfer units each carrying a color image multiply superposed image components of a plurality of colors, and the image position adjusting means further comprises a contact/separating means for separating both intermediate transfer units when the image on each of the intermediate transfer units passes a secondary transfer area without transferring on the recording medium and for bringing both intermediate transfer units in contact with or proximity to each other when the image on each intermediate transfer unit is transferred on the recording medium.

16. A double-sided image forming apparatus according to claim 9, wherein the first image carrier and second image carrier include a plurality of groups of color component image carriers which carry image components of a plurality of colors, respectively, and the first and second intermediate transfer units transfer and hold the image components from the plurality of groups of color component image carriers.

* * * * *